US010106343B2

(12) United States Patent
Kimura et al.

(10) Patent No.: US 10,106,343 B2
(45) Date of Patent: Oct. 23, 2018

(54) SHEET STACKING DEVICE, IMAGE FORMING DEVICE, AND REGULATION MEMBER

(71) Applicant: KONICA MINOLTA, INC., Chiyoda-ku, Tokyo (JP)

(72) Inventors: Akio Kimura, Kosai (JP); Shinya Naoi, Toyokawa (JP); Takemune Izumi, Okazaki (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 3 days.

(21) Appl. No.: 15/651,592

(22) Filed: Jul. 17, 2017

(65) Prior Publication Data

US 2018/0029811 A1 Feb. 1, 2018

(30) Foreign Application Priority Data

Jul. 28, 2016 (JP) ..... 2016-148773

(51) Int. Cl.
*B65H 1/04* (2006.01)
*B65H 1/26* (2006.01)

(52) U.S. Cl.
CPC ..... *B65H 1/266* (2013.01); *B65H 1/04* (2013.01); *B65H 2405/1122* (2013.01);
(Continued)

(58) Field of Classification Search
CPC ..... B65H 1/266; B65H 1/04; B65H 2403/47; B65H 2511/11; B65H 2511/12;
(Continued)

(56) References Cited

U.S. PATENT DOCUMENTS 7,607,657 B2 * 10/2009 Kawarago ..... B65H 1/266 271/171
7,694,958 B2 * 4/2010 Nakamura ..... G03G 15/6502 271/145

(Continued)

FOREIGN PATENT DOCUMENTS

JP 6-32468 A 2/1994
JP 2000007162 A * 1/2000

(Continued)

*Primary Examiner* — Luis A Gonzalez
(74) *Attorney, Agent, or Firm* — Buchanan Ingersoll & Rooney PC

(57) ABSTRACT

A sheet stacking device including: a stacking unit; and a regulation member movably supported by the stacking unit and contacting a sheet edge to regulate a sheet position. The regulation member includes: a locking member movable between an engagement position and a disengagement position; a biasing member biasing the locking member toward the engagement position; a force receiver receiving a user operation; a releaser converting a first force in a first direction applied to the force receiver into a second force in a second direction opposing a biasing force from the biasing member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

13 Claims, 12 Drawing Sheets

(52) U.S. Cl.
CPC .... *B65H 2405/121* (2013.01); *B65H 2511/10* (2013.01); *B65H 2511/11* (2013.01); *B65H 2511/12* (2013.01); *B65H 2511/20* (2013.01)

(58) Field of Classification Search
CPC ..... B65H 2701/113; B65H 2701/1131; B65H 2405/121
See application file for complete search history.

(56) References Cited

U.S. PATENT DOCUMENTS

| | | | | |
|---|---|---|---|---|
| 8,622,383 | B2 * | 1/2014 | Lee | B65H 1/266 271/171 |
| 9,663,312 | B1 * | 5/2017 | McFarland | B65H 1/266 |
| 9,746,807 | B2 * | 8/2017 | Nishioka | G03G 15/6502 |
| 2010/0270735 | A1 * | 10/2010 | Allwright | B65H 1/266 271/171 |
| 2015/0102552 | A1 * | 4/2015 | Doshida | B65H 1/04 271/171 |

FOREIGN PATENT DOCUMENTS

| | | | |
|---|---|---|---|
| JP | 2002-255358 | A | 9/2002 |
| JP | 2008-105856 | A | 5/2008 |
| JP | 2010-6596 | A | 1/2010 |
| JP | 2011-201703 | A | 10/2011 |

* cited by examiner

FIG. 8A <Locked>
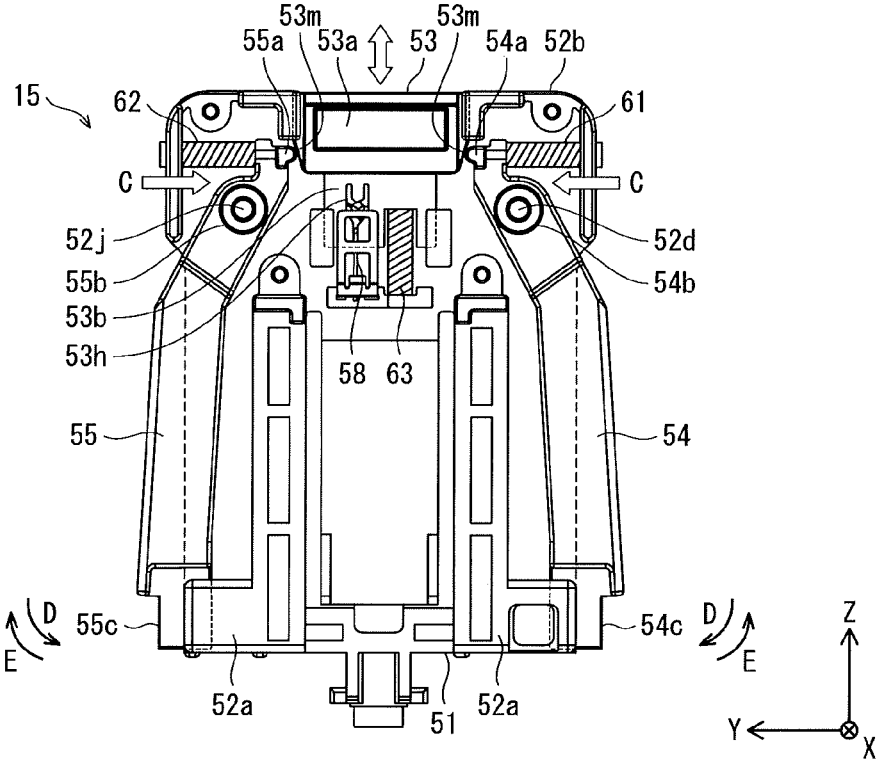
FIG. 8B <Unlocked>
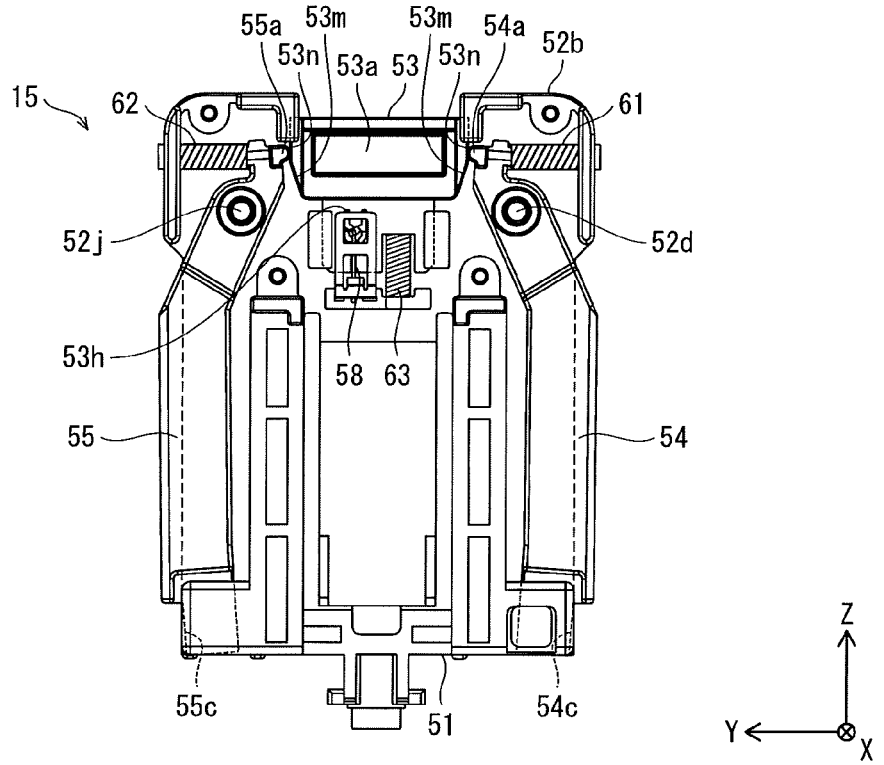

FIG. 11A <Locked>
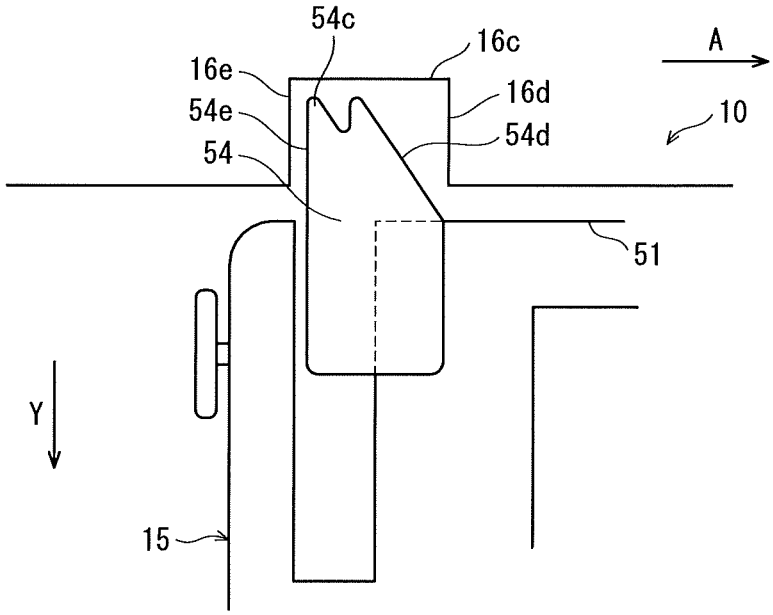
FIG. 11B <Unlocked>
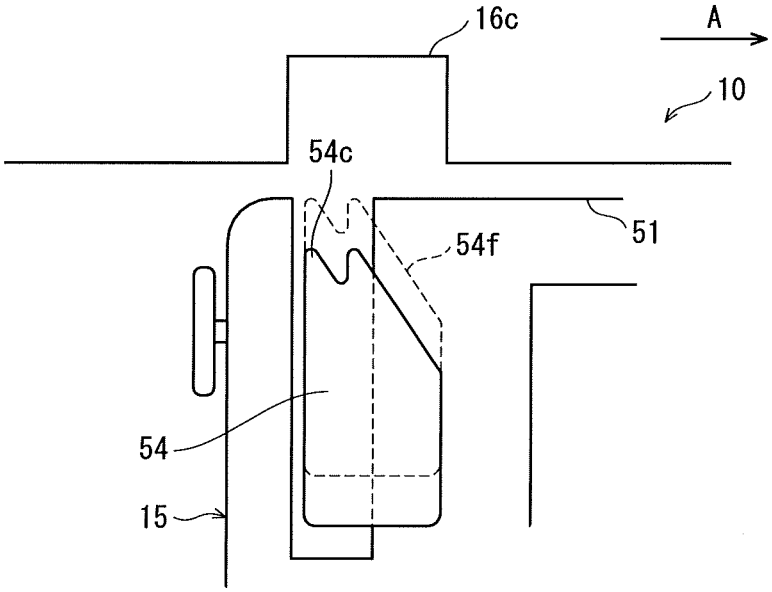

SHEET STACKING DEVICE, IMAGE FORMING DEVICE, AND REGULATION MEMBER

Japanese Patent Application No. 2016-148773 filed on Jul. 28, 2016, including description, claims, drawings, and abstract, is incorporated herein by reference in its entirety.

BACKGROUND

Technical Field

The present invention relates to a sheet stacking device in which sheets are stacked, an image forming device including the sheet stacking device, and a regulation member.

Description of the Related Art

Image forming devices such as printers stack and house sheets in sheet stacking devices such as sheet feed cassettes, convey the sheets one by one to a conveyance path, and form an image on each of the sheets.

Such a sheet stacking device includes a regulation member that contacts, when a sheet is housed in the sheet stacking device, an upstream end of the sheet in a conveyance direction (rear end in the conveyance direction) or a lateral end of the sheet in a width direction orthogonal to the conveyance direction and thereby regulates a position of the sheet upstream in the conveyance direction or in the width direction.

In many structures, the regulation member is supported so that the regulation member is movable in the conveyance direction (or the width direction) of sheets. For example, when replacing sheets of A4 size with sheets of B5 size, a user can move the regulation member from a regulation position corresponding to the A4 size to a regulation position corresponding to the B5 size. This structure makes the sheet stacking device compatible with sheets of different sizes.

When the regulation member is moved by a user to a regulation position corresponding to the size of the sheets, the regulation member is locked so that the regulation member does not move from the regulation position. Japanese Patent Application Publication No. 2010-6596 discloses, as such a locking mechanism, a structure in which a stopper of the regulation member is engaged with a rack unit at a bottom surface of the sheet stacking device. In order to maintain such an engagement, a restoring force of a spring is utilized. Unlocking of the regulation member is achieved by a user pushing a release lever in a travel direction of the regulation member with a force greater than the restoring force of the spring.

Problems to be Solved by the Invention

According to the structure disclosed by Japanese Patent Application Publication No. 2010-6596, in order to unlock the regulation member and move the regulation member to another regulation position, a user has to apply to the regulation member a force greater than the restoring force of the spring that maintains the engagement of the regulation member and continue to push the regulation member to maintain unlocking of the regulation member.

Continuing to apply a great force to the regulation member is a burden for a user. Further, when an amount of the force applied to the regulation member by the user is insufficient, the user may fail to stop the regulation member at a desired regulation position. Also, when the force applied to the regulation member by the user is too great, the regulation member may be pushed into the sheets while the regulation member is in contact with the sheets, which may result in damaging the sheets.

Problems as described above are not limited to sheet feed cassettes of image forming devices, and may occur in any sheet stacking device including a regulation member regulating a position of a sheet in the sheet stacking device.

SUMMARY

An object of the present invention is to provide a sheet stacking device whose regulation member is manipulated by a user with ease, an image forming device including such a sheet stacking device, and a regulation member.

To achieve at least one of the abovementioned objects, a sheet stacking device reflecting one aspect of the present invention includes: a stacking unit in which a sheet is stacked; and a regulation member that is movably supported by the stacking unit and is brought into contact with an edge of the sheet to regulate a position of the sheet. In the sheet stacking device, the regulation member includes: a locking member that is movable between an engagement position and a disengagement position, the engagement position being a position at which the locking member is engaged with an engaging portion of the stacking unit, and the disengagement position being a position at which the locking member is disengaged from the engaging portion; a biasing member that biases the locking member toward the engagement position; a force receiver that receives a user operation; a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the invention.

In the drawings:

FIG. 8A is a left lateral view of the rear end regulation plate in a locked state, after removal of a certain member, and FIG. 8B is a left lateral view of the rear end regulation plate in an unlocked state, after removal of the certain member;

FIG. 11A is a bottom view schematically illustrating a positional relationship between protrusions of a lever and a recess of a bottom surface in the locked state, and FIG. 11B is a bottom view schematically illustrating the protrusions of the lever and the recess of the bottom surface in the unlocked state;

DETAILED DESCRIPTION OF EMBODIMENTS

Hereinafter, one or more embodiments of the present invention will be described with reference to the drawings. However, the scope of the invention is not limited to the disclosed embodiments.

The following describes an embodiment of a sheet stacking device, an image forming device, and a regulation member pertaining to the present invention, taking a tandem-type color printer (hereinafter referred to as "printer") as an example.

[1] Overall Structure of Printer

Figure 1:
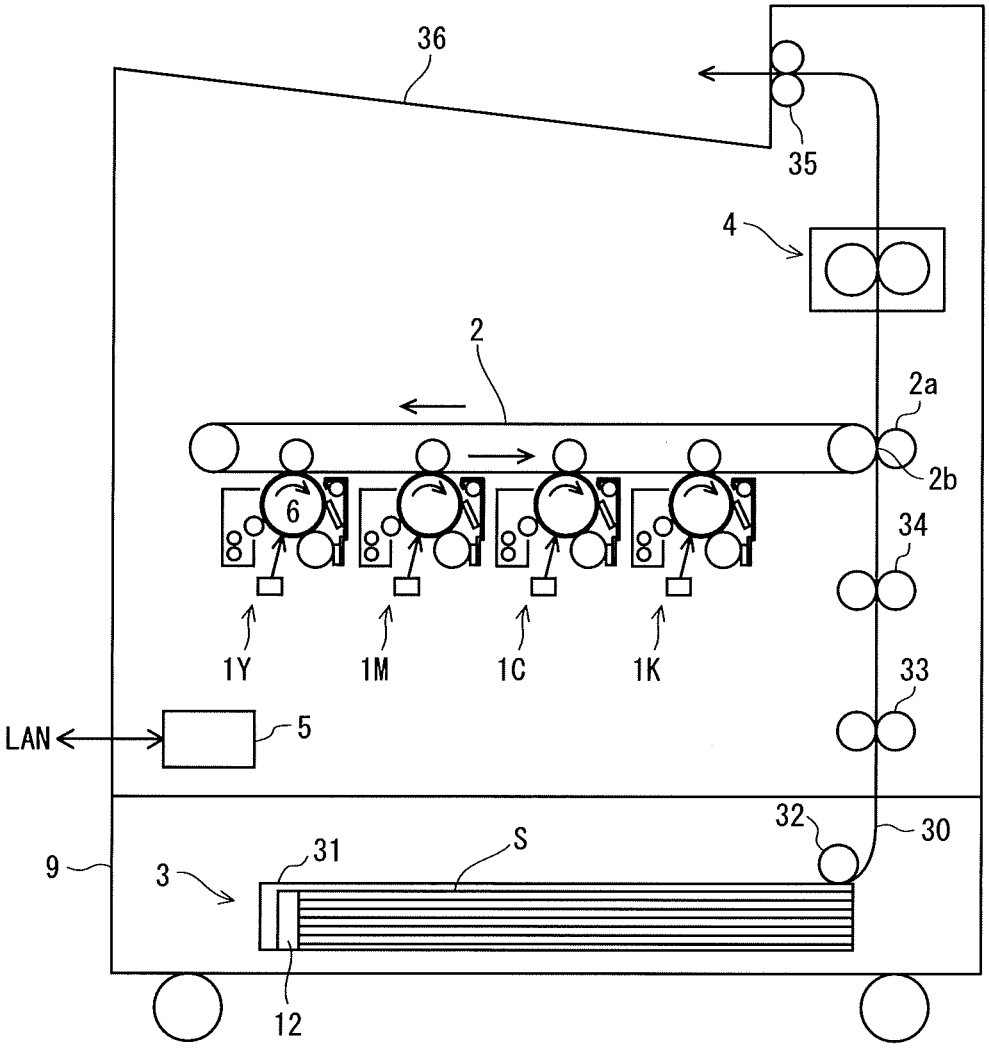
FIG. 1 illustrates an overall structure of a printer.

FIG. 1 illustrates an overall structure of the printer.

As illustrated in FIG. 1, the printer forms images by a known electrophotographic system, and includes image forming units 1Y, 1M, 1C, and 1K, an intermediate transfer belt 2, a sheet feed unit 3, a fixing unit 4, and a control unit 5. The printer is connected to a network (such as a local area network (LAN)), and upon receiving a print job execution instruction from an external terminal device (not illustrated), executes forming of color images each consisting of a different one of colors yellow (Y), magenta (M), cyan (C), and black (K) on the basis of the instruction.

The image forming units 1Y, 1M, 1C, and 1K are arrayed in parallel directly below the intermediate transfer belt 2 along a travel direction of the intermediate transfer belt 2.

The image forming unit 1Y forms a toner image of the Y color on a photoreceptor drum 6 that rotates in a direction indicated by an arrow in FIG. 1. Other image forming units 1M, 1C, and 1K have the same structure as the image forming unit 1Y, and therefore the reference numeral 6 is omitted. The image forming units 1M, 1C, and 1K form toner images of corresponding colors (M, C, K) respectively on corresponding photoreceptor drums 6.

The sheet feed unit 3 includes components such as a sheet feed cassette 31, a pickup roller 32, conveyance rollers 33, and timing rollers 34.

The sheet feed cassette 31 is a sheet stacking device for stacking and housing sheets S as recording sheets, and is supported by a device main body 9 so that the sheet feed cassette 31 can be pulled out toward a device front side relative to the device main body 9. When supplying a sheet S into the sheet feed cassette 31, a user pulls out the sheet feed cassette 31 toward the device front side, puts a new sheet S into the sheet feed cassette 31, and pushes back the sheet feed cassette 31 toward a device back side so that the sheet feed cassette 31 is in its original sheet feed position.

The pickup roller 32 picks up a sheet S from the sheet feed cassette 31 and feeds the sheet S to a conveyance path 30. The conveyance rollers 33 convey the sheet S downstream in a conveyance direction.

The timing rollers 34 are driven according to a timing at which the sheet S conveyed by the conveyance rollers 33 is conveyed to secondary transfer rollers 2*a*.

The fixing unit 4 includes a fixing roller and a pressure roller that fix the toner images by heating and pressurizing the sheet S at a predetermined fixing temperature.

The control unit 5 causes, on the basis of image data from the external terminal device, the image forming units 1Y, 1M, 1C, and 1K to respectively form toner images on the corresponding photoreceptor drums 6.

The toner images on the photoreceptor drums 6 are transferred onto the intermediate transfer belt 2 (primary transfer). Here, each of the toner images is transferred at a different timing so that the toner images are transferred onto the same position of the intermediate transfer belt 2.

The toner images that are transferred onto the same position of the intermediate transfer belt 2 move, through a circular travel of the intermediate transfer belt 2, to a secondary transfer position 2*b* at which the secondary transfer rollers 2*a* are pressed onto the intermediate transfer belt 2.

In accordance with the image forming timing described above, the sheet S is conveyed from the timing rollers 34 of the sheet feed unit 3. The sheet S is conveyed while being sandwiched between the intermediate transfer belt 2, which travels in circulation, and the secondary transfer rollers 2*a*. The toner images on the intermediate transfer belt 2 are then transferred all at once onto the sheet S at the secondary transfer position 2*b* (secondary transfer).

After passing through the secondary transfer position 2*b*, the sheet S is conveyed to the fixing unit 4, and the toner image is fixed to the sheet S through heat and pressure at the fixing unit 4. The sheet S is then ejected by ejection rollers 35 and is stored in a storage tray 36.

[2] Structure of Sheet Feed Cassette

Figure 2:
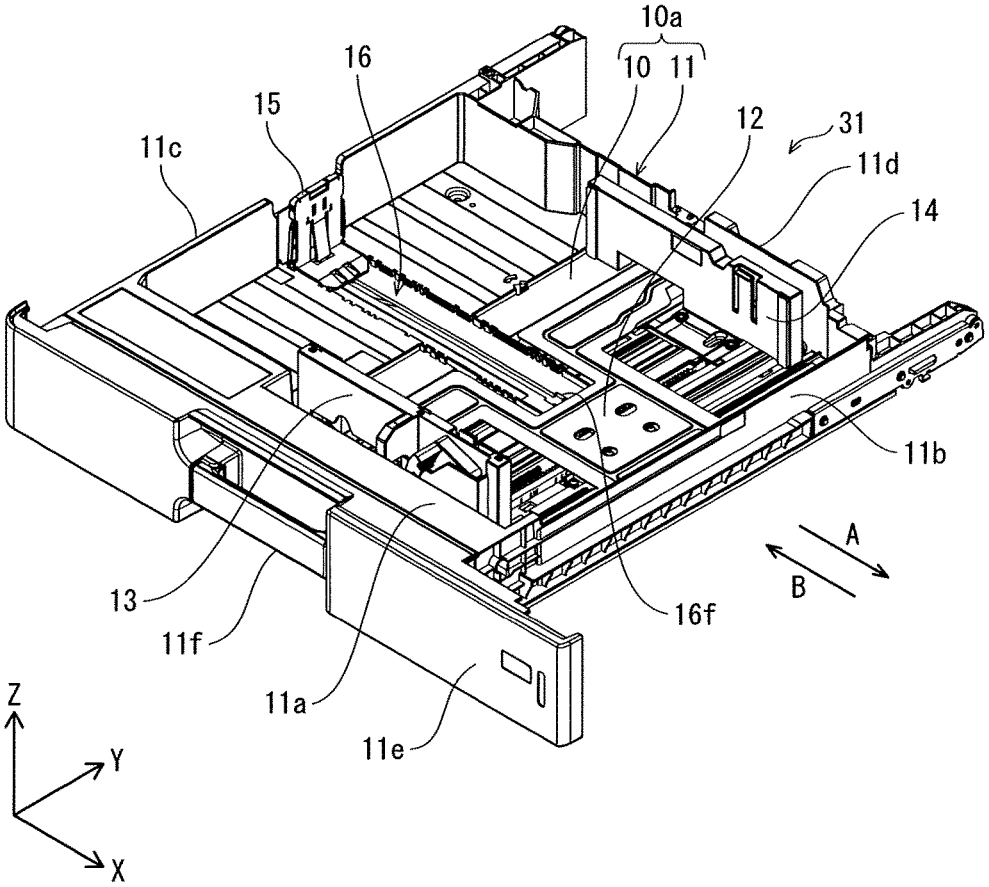
FIG. 2 is a perspective view illustrating a structure of a sheet feed cassette.

FIG. 2 is a perspective view illustrating a structure of the sheet feed cassette 31. FIG. 2 illustrates the sheet feed cassette 31 when pulled out to the device front side, and the pickup roller 32 and the device main body 9 are not illustrated. Further, in FIG. 2, a direction parallel to a pickup direction (sheet feed direction) of sheets S is illustrated as an X-axis direction, a depth direction of the sheet feed cassette 31 is illustrated as a Y-axis direction, and a height direction of the sheet feed cassette 31 is illustrated as a Z-axis direction. Further, the sheet feed direction is illustrated as a direction indicated by arrow A, and a direction (direction of the rear end of sheets S) opposite the sheet feed direction is indicated by arrow B.

As illustrated in FIG. 2, the sheet feed cassette 31 includes a substantially rectangular bottom surface 10 and side walls 11 surrounding the bottom surface 10. The bottom surface 10 and the side walls 11 form a sheet stack unit 10*a* in which sheets S are stacked and housed.

The side walls 11 include a front side wall 11*a* at the device front side, a right side wall 11*b*, a left side wall 11*c*, and a back side wall 11*d*. The front side wall 11*a* has a cover 11*e* attached thereto. The cover 11*e* has a handle 11*f* that a user holds when the user pulls out the sheet feed cassette 31 to the device front side or when the user pushes the sheet feed cassette 31 into the device back side.

A guiding region 16 is arranged at the bottom surface 10. The guiding region 16 extends in the sheet feed direction (direction of arrow A) of sheets S, and a rear end regulation plate 15 is arranged so as to be slidable along the guiding region 16. The rear end regulation plate 15 regulates, in accordance with the size (such as A4 and B5) of sheets S stacked onto the bottom surface 10, a position of an edge (sheet rear end) of the sheets S in a sheet rear end direction (direction of arrow B).

A push-up plate 12 is disposed on the bottom surface 10, at a front of the bottom surface 10 in the sheet feed direction. When the sheet feed cassette 31 is at the sheet feed position (that is, when the sheet feed cassette 31 is pushed into the device main body 9), the push-up plate 12 pushes up, from the bottom surface 10, a portion at a front in the sheet feed direction of the sheets S stacked and housed in the sheet feed cassette 31, and pushes an uppermost sheet S onto the pickup roller 32. In this state, a rotation of the pickup roller 32 causes the uppermost sheet S to be fed to the conveyance path 30.

Side regulation plates 13 and 14 that are spaced away from each other in the Y-axis direction are disposed between the front side wall 11*a* and the back side wall 11*d*. The side regulation plates 13 and 14 are supported by guiding grooves (not illustrated) arranged at the bottom surface 10 and extending in the Y-axis direction, so that the side regulation plates 13 and 14 are slidable on the bottom surface 10 in the Y-axis direction. The side regulation plates 13 and 14 regulate positions of edges (sheet side ends) of the sheets S in the Y-axis direction (sheet width direction) in accordance with a size of sheets S stacked on the bottom surface 10.

Figure 3:
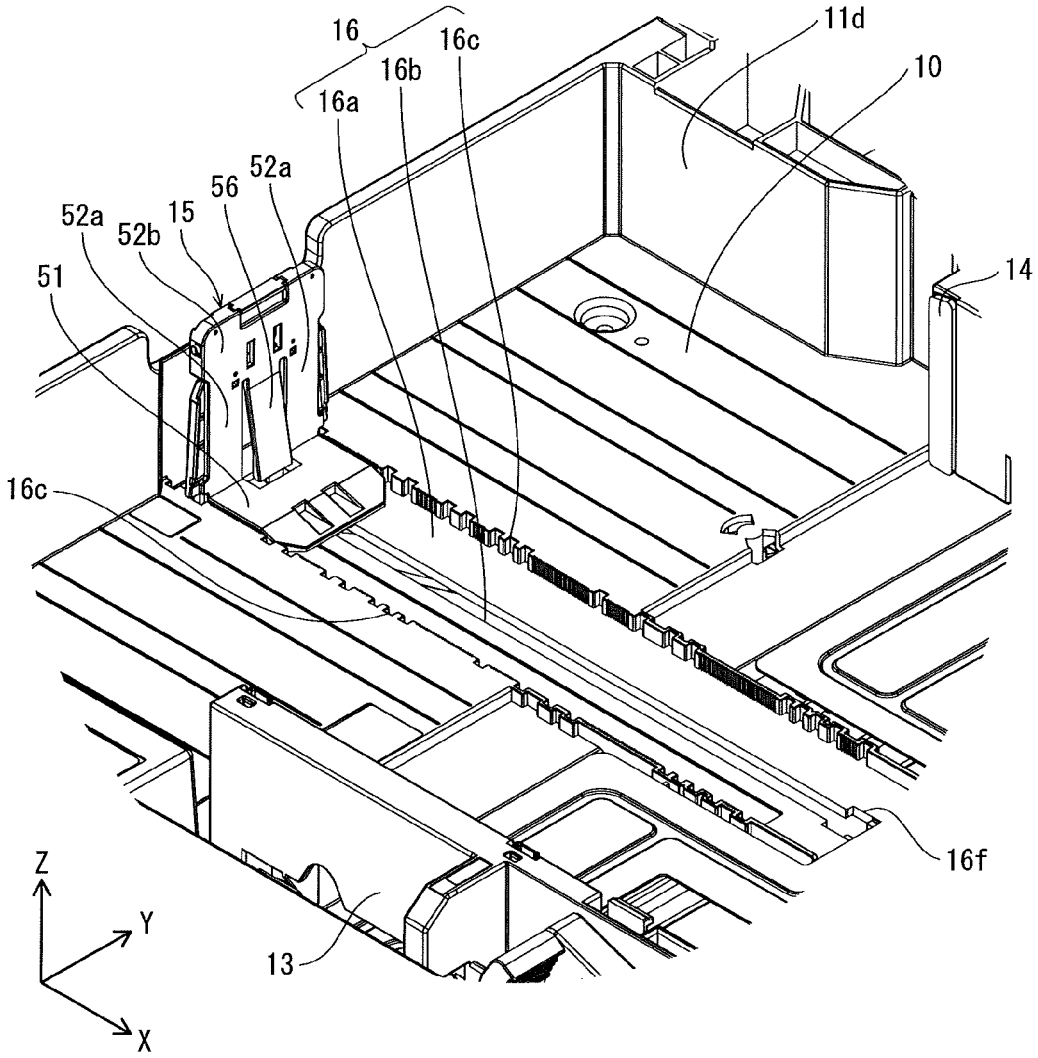
FIG. 3 is an enlarged view illustrating a guiding region at a bottom surface of the sheet feed cassette.

FIG. 3 is an enlarged view of the guiding region 16.

As illustrated in FIG. 3, the guiding region 16 has a low-floor portion 16*a* that is lower in the Z-axis direction than the bottom surface 10, a groove portion 16*b* at a center of the low-floor portion 16*a*, and recesses 16*c* at lateral surfaces of step portions between the bottom surface 10 and the low-floor portion 16*a*.

The low-floor portion 16*a* and the groove portion 16*b* extend in the sheet feed direction.

Figure 4:
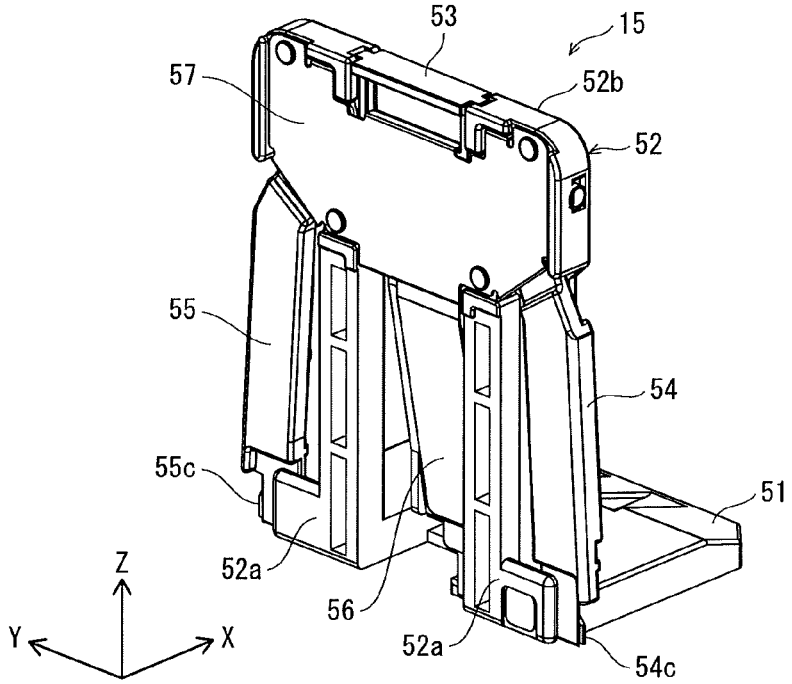
FIG. 4 is a perspective view illustrating a structure of a rear end regulation plate.

Each pair of the recesses 16*c* corresponds to a different one of lengths in the sheet feed direction of sheets S having different sizes. The rear end regulation plate 15 includes a lever 54 having protrusions 54*c* and a lever 55 having protrusions 55*c* (FIG. 4). The protrusions 54*c* and the protrusions 55*c* intrude into (engage with) one of the pairs of the recesses 16*c*, and this causes the rear end regulation plate 15 to be locked (prevented from moving) at the position of the recesses 16*c*. In this sense, the recesses 16*c* function as engaging portions that engage with the protrusions 54*c* of the lever 54 and the protrusions 55*c* of the lever 55.

[3] Structure of Rear End Regulation Plate

Figure 5:
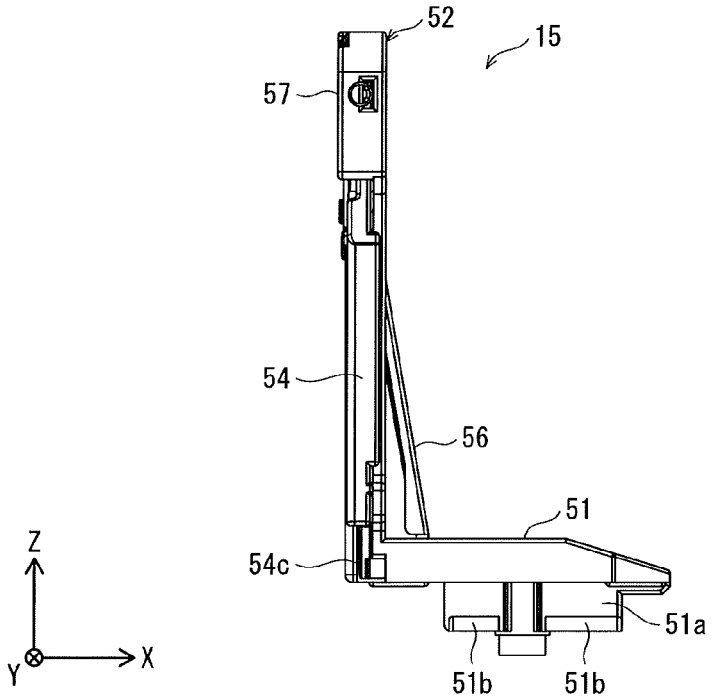
FIG. 5 is a front view of the rear end regulation plate.
Figure 6:
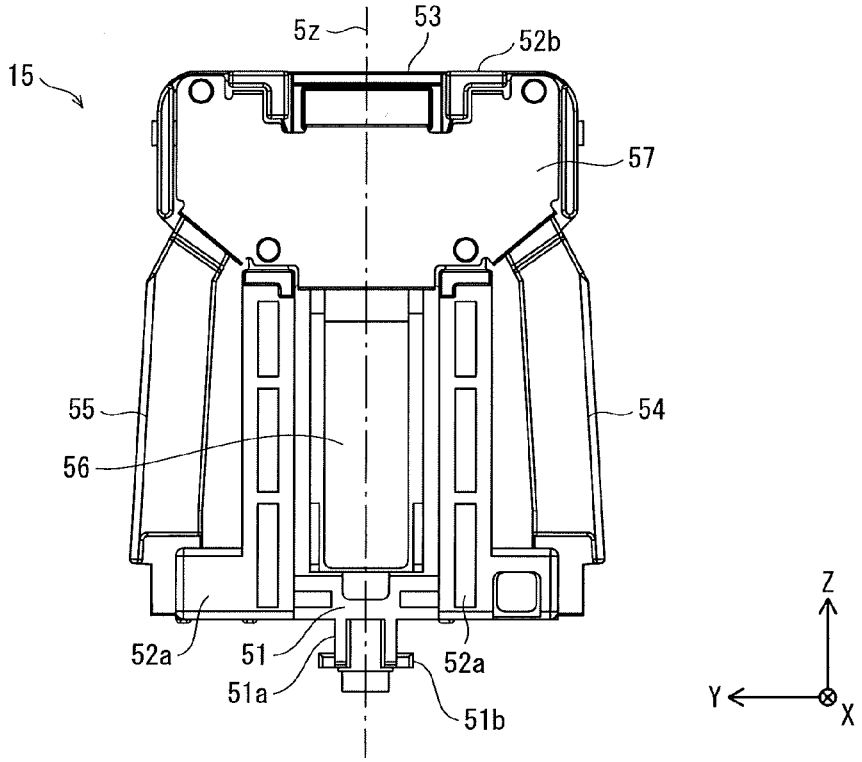
FIG. 6 is a left lateral view of the rear end regulation plate.
Figure 7:
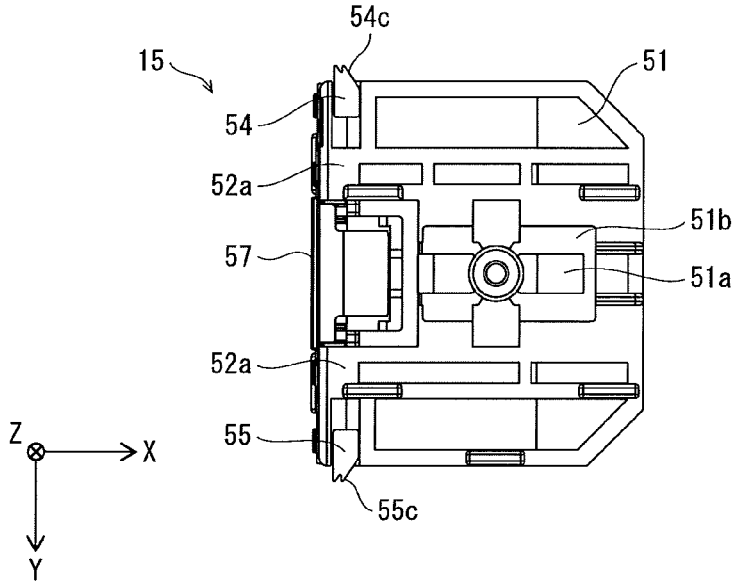
FIG. 7 is a bottom view of the rear end regulation plate.
Figure 9:
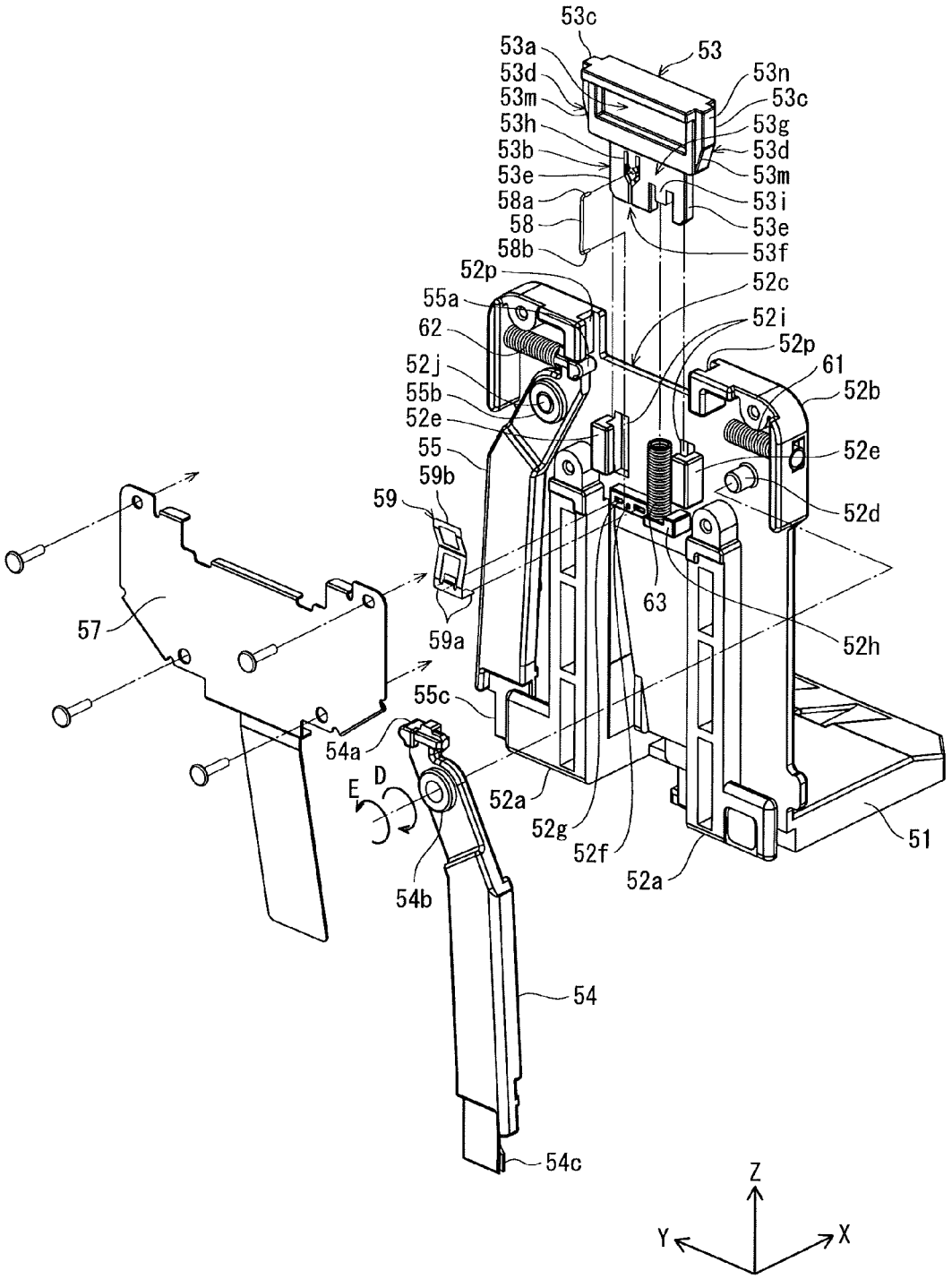
FIG. 9 is an exploded perspective view of the rear end regulation plate.

FIG. 4 is a perspective view illustrating a structure of the rear end regulation plate 15, FIG. 5 is a front view of the rear end regulation plate 15, FIG. 6 is a left lateral view of the rear end regulation plate 15, and FIG. 7 is a bottom view of the rear end regulation plate 15. FIG. 8A and FIG. 8B are left lateral views each illustrating a state after removal of a cover 57 from the rear end regulation plate 15 illustrated in FIG. 6, and FIG. 9 is an exploded perspective view of the rear end regulation plate 15.

As illustrated in FIG. 4, FIG. 5, FIG. 6, FIG. 7, FIG. 8A, FIG. 8B, and FIG. 9, the rear end regulation plate 15 includes a base 51, a body 52, an operation member 53, the levers 54 and 55, an elastic piece 56, and the cover 57. These members are made of resin here. However, the present embodiment is not limited to this, and the members may be made of another material such as a metal. Further, each of the members may be made of a different material. For example, one member may be made of a resin, while another member may be made of a metal.

The base 51 is a plate-like member having a substantially trapezoidal shape, and a guiding member 51*a* protruding in a downward direction is arranged at a lower surface of the base 51. A projecting portion 51*b* extending from the guiding member 51*a* in a direction orthogonal to the downward direction is arranged at a leading end of the guiding member 51*a*.

During assembly, the guiding member 51*a* of the base 51 is inserted from an opening 16*f* (FIG. 3) at a front of the groove portion 16*b* of the guiding region 16 in the sheet feed direction and is moved in the sheet rear end direction of sheets S. Consequently, the low-floor portion 16*a* of the guiding region 16 is sandwiched by the base 51 and the projecting portion 51*b*, preventing the rear end regulation plate 15 from detaching from the groove portion 16*b*.

The body 52 is at an end of the base 51 in the sheet rear end direction, and has two walls 52*a* protruding at ends of the body 52 in the Y-axis direction and having a gap between each other in the Y-axis direction, and an upper body portion 52*b* connecting upper ends of the walls 52*a*.

The operation member 53 receives from a user a locking operation for establishing locking of the rear end regulation plate 15 at a regulation position at the sheet rear end and an unlocking operation for releasing the locking.

As illustrated in FIG. 9, the operation member 53 is a plate-like member that, broadly speaking, is divided into a receiving portion (force receiver) 53*a* that is an upper portion of the operation member 53 and a guiding portion 53*b* that is a lower portion of the operation member 53.

The receiving portion 53*a* receives a force that the user applies by pushing down the operation member 53. The receiving portion 53*a* has, at each end of the receiving portion 53*a* in the Y-axis direction, a ridge portion 53*c* and a tapered portion 53*d*. The ridge portion 53*c* is elongated in the Z-axis direction. The tapered portions 53*d* each taper so that the length of the receiving portion 53*a* in the Y-axis direction is shorter toward a lower end of the receiving portion 53*a*, and each have a tapered surface continuing from a lower end of the ridge portion 53*c*.

The upper body portion 52*b* has a cut-out portion 52*c*. At each end of the cut-out portion 52*c* in the Y-axis direction is a guiding groove 52*p* elongated in the Z-axis direction. The ridge portions 53*c* fit into the guide grooves 52*p* and are supported so that the ridge portions 53*c* are movable in the Z-axis direction along the guiding grooves 52*p*.

The guiding portion 53*b* has a shorter length in the Y-axis direction and a smaller thickness than the receiving portion 53*a*. Each side end 53*e* of the guiding portion 53*b* in the Y-axis direction is supported by a guiding member 52*e* so that each side end 53*e* is movable in the Z-axis direction. The guiding members 52*e* are elongated in the Z-axis direction and are located below the cut-out portion 52*c* of the upper body portion 52*b*. Consequently, the operation member 53 is movable in the Z-axis direction relative to the upper body portion 52*b*.

The guiding portion 53*b* has a guiding groove arrangement portion 53*f* and a spring holding portion 53*g* arrayed in the Y-axis direction. The guiding groove arrangement portion 53*f* has a main surface where a guiding groove 53*h* is arranged. The guiding groove 53*h* has a Y-shape in front view from the X-axis direction. The spring holding portion 53*g* has a projecting portion 53*i* projecting downward.

The guiding groove 53*h* is a bottomed groove engaged with a guiding rod 58. As described below, the guiding groove 53*g* has portions with different depths, and the narrowest portion of the guiding groove 53*h* has a width of, for example, about 0.8 mm.

The guiding rod 58 is made of a metal material such as a piano wire or a drawn steel wire having a small diameter (for example, 0.5 mm), and has a straight portion, a bent portion 58*a* at an upper end of the straight portion, and a bent portion 58*b* at a lower end of the straight portion. The bent portions 58*a* and 58*b* are formed by bending the metal material at a right angle.

The bent portion (engagement projection) 58*a* of the guiding rod 58 fits into the guiding groove 53*h*, and has a length greater than the depth of the deepest portion of the guiding groove 53*h*. The bent portion 58*b* of the guiding rod 58 fits into and is fixed to a recess 52*f* at a lower end of the upper body portion 52*b*. Because the bent portion 58*b* of the guiding rod 58 is fixed to the recess 52*f*, the guiding rod 58 is fixed to the upper body portion 52*b*.

The guiding rod 58 is biased by a biasing force from the leaf spring 59 so that the bent portion 58*a* is always in contact with the bottom surface of the guiding groove 53*h*. The leaf spring 59 has two protrusions 59*a* at its lower end. The protrusions 59*a* fit into and are fixed to two recesses 52*g* at the lower end of the upper body portion 52*b*. The leaf spring 59 further has an upper end 59*b* that applies the biasing force to the bent portion 58*a* in a direction in which the bent portion 58*a* is pressed onto the bottom surface of the guiding groove 53*h*.

Figure 10A:
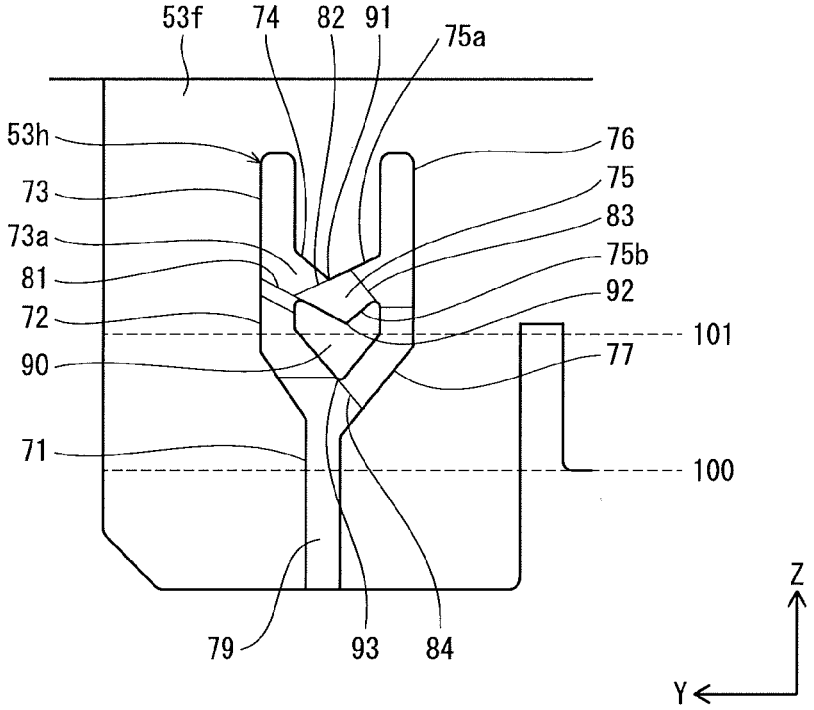
FIG. 10A is a front view of a guiding groove arrangement portion.
Figure 10B:
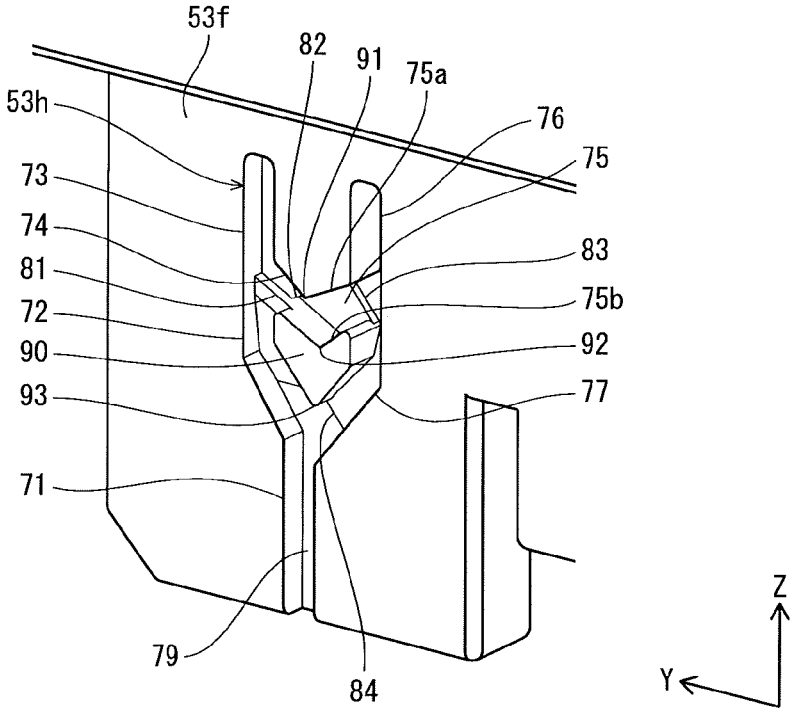
FIG. 10B is a perspective view of the guiding groove arrangement portion.

FIG. 10A is a front view of the guiding groove arrangement portion 53*f*, and FIG. 10B is a perspective view of the guiding groove arrangement portion 53*f*. In the following, the terms "left" and "right" are used relative to the Y-axis direction, and the terms "up", "upper", "down", and "lower" are used relative to the Z-axis direction. As illustrated in FIG. 10A and FIG. 10B, the guiding groove 53*h* surrounds a central region 90 of the guiding groove arrangement portion 53*f*, and includes grooves 71 through 77.

The groove 71 is elongated in the Z-axis direction, and is located at a position lower than the other grooves 72 through 77. As illustrated in FIG. 10B, the grooves 71 through 77 included in the guiding groove 53*h* each have a bottom surface 79 of a different depth. The depth of the bottom surface 79 of the groove 71 in the X-axis direction is hereinafter referred to as a reference depth, and the bottom surfaces 79 of the grooves 72 through 77 are each described as having a depth smaller or greater than the reference depth.

The groove 72 extends obliquely left and upward from an upper end of the groove 71. The bottom surface 79 of the groove 72 slopes so that the bottom surface 79 of the groove 72 has a depth smaller than the reference depth toward an upper end of the groove 72.

The groove 73 extends upward from the upper end of the groove 72. The groove 72 connects to the groove 73 at a level difference 81, and the upper end of the groove 72 inclines so that the level difference 81 is not parallel to the Y-axis direction but has a right end lower than the left end. Due to the level difference 81, the bottom surface 79 of the groove 73 has a depth greater than the bottom surface 79 at the upper end of the groove 72.

The groove 74 extends from a branching position 73*a* at a lower end of the groove 73, and forms an inclining groove portion inclining at an acute angle from a direction extending from upward to downward, that is, a direction along the groove 72 away from the branching portion 73*a* (third direction).

The groove 75 has a V-shape in front view. A left upper end of the groove 75 connects to a terminal end of the groove 74 at a level difference 82, and forms a bending groove portion that bends in a direction away from the third direction relative to the terminal end of the groove 74. Because of the level difference 82, the bottom surface 79 of the groove 75 has a depth greater than the bottom surface 79 of the groove 74. When regarding the grooves 71, 72, and 73 as a single groove (first groove) extending in the Z-axis direction and the grooves 74 and 75 as another groove (second groove), the second groove can be regarded as a branching groove branching from the first groove at the branching position 73*a*.

The groove 75 has a right upper end connecting to a lower end of the groove 76 at a level difference 83. Because of the level difference 83, the bottom surface 79 of the groove 76 has a depth greater than the bottom surface 79 of the groove 75.

The groove 76 extends upward from its lower end, to which the right upper end of the groove 75 connects at the level difference 83.

The groove 77 extends obliquely left and downward from a lower end of the groove 76. The bottom surface 79 of the groove 77 slopes so that the bottom surface 79 of the groove 77 has a depth smaller than the bottom surface 79 of the groove 76 toward a lower end of the groove 77. The bottom surface 79 at the lower end of the groove 77 has a depth smaller than the reference depth, and the lower end of the groove 77 continues to the upper end of the groove 71 at a level difference 84.

As described above, the grooves 71 through 77 are continuous around the central region 90, starting from the groove 71, passing the grooves 72 through 77 in this order, and eventually returning to the groove 71, via the level differences 81 through 84. The central region 90 has a substantially V-shape in front view, and is on the same plane as portions of the guiding groove arrangement portion 53*f* where the guiding groove 53*h* is not arranged.

The groove 74 and the groove 76 connect to each other through the groove 75, which has a V-shape. The groove 75 is formed by the bottom surface 79, an upper side wall 75*a*, and a lower side wall 75*b*. The upper side wall 75*a* and the lower side wall 75*b* both protrude from the bottom surface 79. The upper side wall 75*a* and the lower side wall 75*b* each have a V-shape in front view and an angular portion in a downward direction. A position of an angular portion 92 of the lower side wall 75*b* is slightly removed to the right from a position of an angular portion 91 of the upper side wall 75*a*. Further, a position of an angular portion 93 at a lower end of the central region 90 is slightly removed to the right from the groove 71. The reason why the angular portions 91 and 92 are removed from each other and the angular portion 93 is removed from the groove 71 is described later.

Going back to FIG. 9, a compression spring 63 is disposed between the projecting portion 53*i* of the spring holding portion 53*g* and a receiving portion 52*h* at a lower end of the upper body portion 52*b*. The operation member 53 always receives a biasing force in an upward direction from the compression spring 63. The upper body portion 52*b* has two penetrating holes 52*i* elongated in the Z-axis direction in proximity of the guiding member 52*e*. Protrusions (not illustrated) at a rear surface of the guiding portion 53*b* intrude into the penetrating holes 52*i*, and the range in the Z-axis direction within which the protrusions can move is limited to the range in a longitudinal direction of the penetrating holes 52*i*. Here, an upper limit position of the operation member 53 is determined when the protrusions of the guiding portion 53*b* are at upper ends in the longitudinal direction of the penetrating holes 52*i*. Accordingly, although the operation member 53 always receives the biasing force from the compression spring 63, the operation member 53 does not move to a position above the upper limit position and stops at the upper limit position. Such an upper limit position is referred to as an initial position.

As described above, the guiding rod 58 is fixed to the upper body portion 52*b*. However, the operation member 53 is movable in the Z-axis direction relative to the upper body portion 52*b*. Accordingly, when the operation member 53 moves in the Z-axis direction, the bent portion 58*a* moves relative to the grooves 71 through 77 of the guiding groove 53*h* so that the bent portion 58*a* traces a locus of a Y-shape along the grooves 71 through 77 (hereinafter referred to as a relative movement). Details of this relative movement are described later.

The lever 54 is a plate-like member elongated in the Z-axis direction along one wall 52*a*, and the lever 55 is a plate-like member elongated in the Z-axis direction along the other wall 52*a*. The levers 54 and 55 and the two walls 52*a* are arranged such that the two walls 52*a* are between the levers 54 and 55 in the Y-axis direction. The levers 54 and 55 have symmetry about line 5*z* (FIG. 6) indicating a center of the rear end regulation plate 15 in the Y-axis direction.

As illustrated in FIG. 9, the lever 54 has a through hole 54*b* at a position slightly lower than an upper end 54*a*, and a pin 52*d* standing on the upper body portion 52*b* fits into the through hole 54*b*. The lever 54 is supported by the pin 52*d* so that the lever 54 is swingable about the pin 52*d* in a direction indicated by arrow D and in a direction indicated by arrow E opposite the direction indicated by arrow D.

As illustrated in FIG. 8A and FIG. 8B, the upper end 54*a* of the lever 54 is always biased in a direction indicated by arrow C by a biasing force from the compression spring 61 at the upper body portion 52*b*, and is pressed onto the receiving portion 53*a* of the operation member 53. The lever 55 has a similar structure.

That is, the lever 55 has a through hole 55*b* into which a pin 52*j* standing on the upper body portion 52*b* fits. The upper end 55*a* of the lever 55 is always biased in a direction indicated by arrow C by a biasing force from the compression spring 62 at the upper body portion 52*b* and is pressed onto the receiving portion 53*a* of the operation member 53.

The lever 54 has, at a surface of its lower end portion in a direction away from a center of the body 52, the protrusions 54*c* for locking the rear end regulation plate 15. Likewise, the lever 55 has, at another surface of its lower end in a direction away from the center of the body 52, the protrusions 55*c* for locking the rear end regulation plate 15.

As illustrated in FIG. 3 and FIG. 4, the elastic piece 56 has an upper end connected to the upper body portion 52*b* and an open lower end. The elastic piece 56 inclines so that the closer to the lower end, the more the elastic piece 56 inclines in the sheet feed direction. The elastic piece 56 contacts the rear end of sheets S housed in the sheet feed cassette 31 and biases the sheets S to the sheet feed direction.

The cover 57 shields the upper body portion 52*b* from the outside of the upper body portion 52*b* so that members at the upper body portion 52*b*, such as the guiding rod 58 and the compression springs 61 through 63, are not seen by a user. Further, the cover 57 has a function of lidding the upper body portion 52*b* so that the levers 54 and 55 do not come off. That is, the cover 57 prevents the lever 54, which is supported by the pin 52*d*, from coming off the pin 52*d*. Likewise, the cover 57 prevents the lever 55, which is supported by the pin 52*j*, from coming off the pin 52*j*. Further, the cover 57 has a function of causing the leaf spring 59 to deflect so that the leaf spring 59 can apply a biasing force to the guiding rod 58.

[4] Locking and Unlocking of Rear End Regulation Plate

In the structure described above, both a locking operation and an unlocking operation are achieved by a push-down operation of the operation member 53 by a user. That is, a push-down operation establishes locking of the rear end regulation plate 15, and performing a push-down operation again causes the rear end regulation plate 15 to be released from the locking. The following provides a detailed explanation.

FIG. 8A illustrates the locked state, and FIG. 8B illustrates the unlocked state.

As illustrated in FIG. 8A, the operation member 53 is at the initial position in the locked state. That is, an upper surface of the operation member 53 in the locked state is flush with an upper surface of the upper body portion 52*b*. The levers 54 and 55 as locking members rest with the protrusions 54*c* and 55*c* protruding outward from the base 51. This state is achieved due to the levers 54 and 55 receiving the biasing forces in the directions indicated by arrows C from the compression springs 61 and 62 with the upper end 54*a* and the upper end 55*a* contacting tapered surfaces 53*m* of the tapered portions 53*d* of the operation member 53 and swinging about the pin 52*d* and 52*j* in the directions indicated by arrows E.

FIG. 11A is a bottom view schematically illustrating a positional relationship between the protrusions 54*c* and a recess 16*c* at the guiding region 16 of the bottom surface 10 in the locked state. As illustrated in FIG. 11A, the protrusions 54*c* intrude into (engage with) a recess 16*c*, and the rear end regulation plate 15 is in the locked state; that is, the rear end regulation plate 15 is immovable relative to the bottom surface 10. The position of the lever 54 illustrated in FIG. 11A is hereinafter referred to as an engagement position. The lever 55 has a similar structure. Meanwhile, FIG. 11A illustrates an example including two protrusions 54*c*. However, the number of protrusion (protrusions) 54*c* is not limited to this as long as the protrusion (protrusions) 54*c* can lock the rear end regulation plate 15.

FIG. 8A illustrates positions of the levers 54 and 55 in the locked state, i.e. the levers 54 and 55 at the engagement positions at which the protrusions 54*c* and the protrusions 55*c* are engaged with the recesses 16*c*.

When a user pushes down the operation member 53 in the locked state illustrated in FIG. 8A, Y-axis direction component forces of forces in accordance with tapered angles of the tapered surfaces 53*m* are applied to the upper end 54*a* and the upper end 55*a* as forces in directions opposing the biasing forces from the compression springs 61 and 62 in the directions indicated by arrows C. The tapered surfaces 53*m* function as application portions converting a force in the downward direction (first direction) into forces in directions (second directions) opposing the biasing forces from the compression springs 61 and 62 and applying the forces in the second directions to the levers 54 and 55.

When the push-down force applied by the user becomes stronger and the forces in the directions opposing the biasing forces from the compression springs 61 and 62 become stronger than the biasing forces from the compression springs 61 and 62, the operation member 53 descends. In accordance with the descending of the operation member 53, the tapered surfaces 53*m* of the operation member 53 descend while maintaining their orientations. This causes the upper end 54*a* and the upper end 55*a* to move relative to the tapered surfaces 53*m* so that the upper ends 54*a* and 55*a* climb up the tapered surfaces 53*m*.

This relative movement causes the compression springs 61 and 62 to compress and the lever 54 to swing about the pin 52*d* and the lever 55 to swing about the pin 52*j* in the directions indicated by arrows D. Eventually, the protrusions 54*c* and 55*c* stop in positions inward of the base 51 (unlocked state), as illustrated in FIG. 8B.

FIG. 8B illustrates the upper end 54*a* and the upper end 55*a* that have climbed up the tapered surfaces 53*m* and are positioned at vertical surfaces 53*n* of the ridge portion 53*c* continuing to the tapered surfaces 53*m*.

FIG. 11B is a bottom view schematically illustrating a positional relationship between the protrusions 54*c* and a recess 16*c* of the bottom surface 10 in the unlocked state. As illustrated in FIG. 11B, the protrusions 54*c* are spaced away from (not engaged with) the recess 16*c*, and the rear end regulation plate 15 is in the unlocked state; that is, the rear end regulation plate 15 is released from immovability relative to the bottom surface 10.

As described in "Problems to be Solved by the Invention" above, in a structure in which the operation member 53 automatically returns to its original initial position (i.e. the locked state) because of biasing forces from the compression springs 61 through 63 when the user performs unlocking by pushing down the operation member 53 and then removes her or his hand from the operation member 53, the user has to continue pushing down the operation member 53 in order to maintain the unlocking when moving the rear end regulation plate 15 to another regulation position. This is a burden for a user. Further, when a force of pushing down the operation member 53 increases and friction between the base 51 of the rear end regulation plate 15 and the low-floor portion 16*a* of the bottom surface 10 increases accordingly, the friction may function as a braking force against the movement of the rear end regulation plate 15. This makes it difficult for the user to move the rear end regulation plate 15.

In view of this, the present embodiment has a structure in which the operation member 53 does not return to its original initial position and stops at a holding position at which unlocking of the rear end regulation plate 15 is maintained even when the user removes her or his hand from the operation member 53 after unlocking the rear end regulation plate 15. Maintenance of the unlocking is terminated when the user pushes down the operation member 53 again, and the operation member 53 returns to the initial position and transition to the locked state is achieved. This structure is achieved by the bent portion 58*a* of the guiding rod 58 being guided and moved along the guiding groove 53*h* of the operation member 53 in accordance with a push-down operation of the operation member 53 by a user.

[5] Holding Unlocking and Switching of Locking

FIG. 12 through FIG. 16 illustrate a relative movement of the bent portion 58*a* of the guiding rod 58 along the Y-shaped guiding groove 53*h* in accordance with a push-down operation of the operation member 53 by a user.

Figure 12:
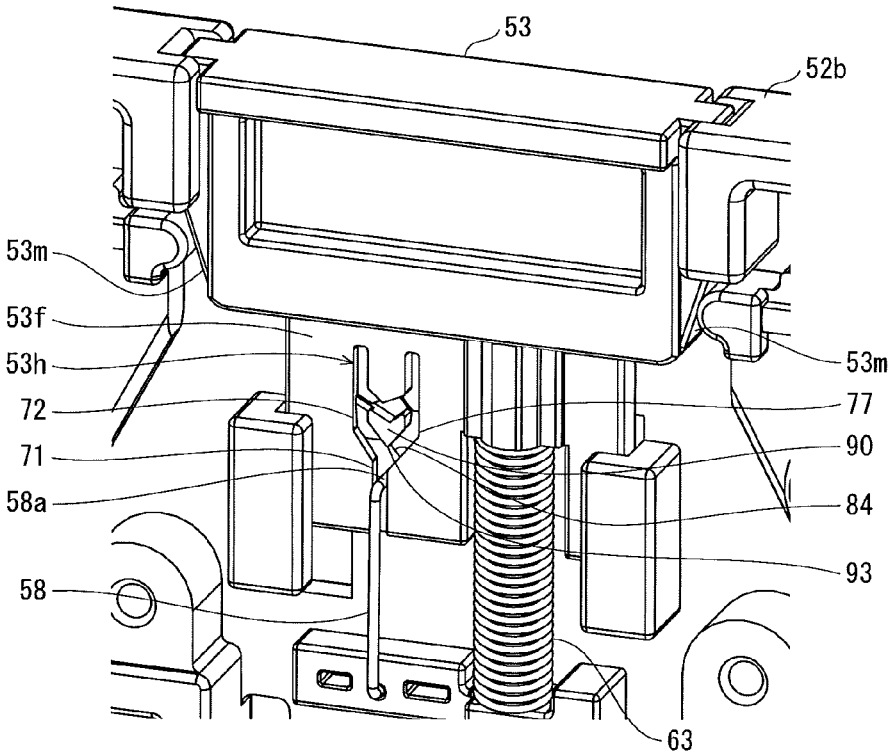
FIG. 12 is a view illustrating a relative movement of a bent portion of a guiding rod relative to a guiding groove in accordance with a push-down operation of an operation member.

FIG. 12 illustrates when the operation member 53 rests in the locked state.

As illustrated in FIG. 12, in the locked state, the operation member 53 rests at the initial position and the bent portion 58*a* fits into the groove 71 of the guiding groove 53*h*. In the locked state, the protrusions 54*c* of the lever 54 and the protrusions 55*c* of the lever 55 are engaged with the recesses 16*c* of the bottom surface 10 as described above. The position of the bent portion 58*a* fitting into the groove 71 when the operation member 53 is at the initial position as illustrated in FIG. 12 is hereinafter referred to as a home position.

Figure 13:
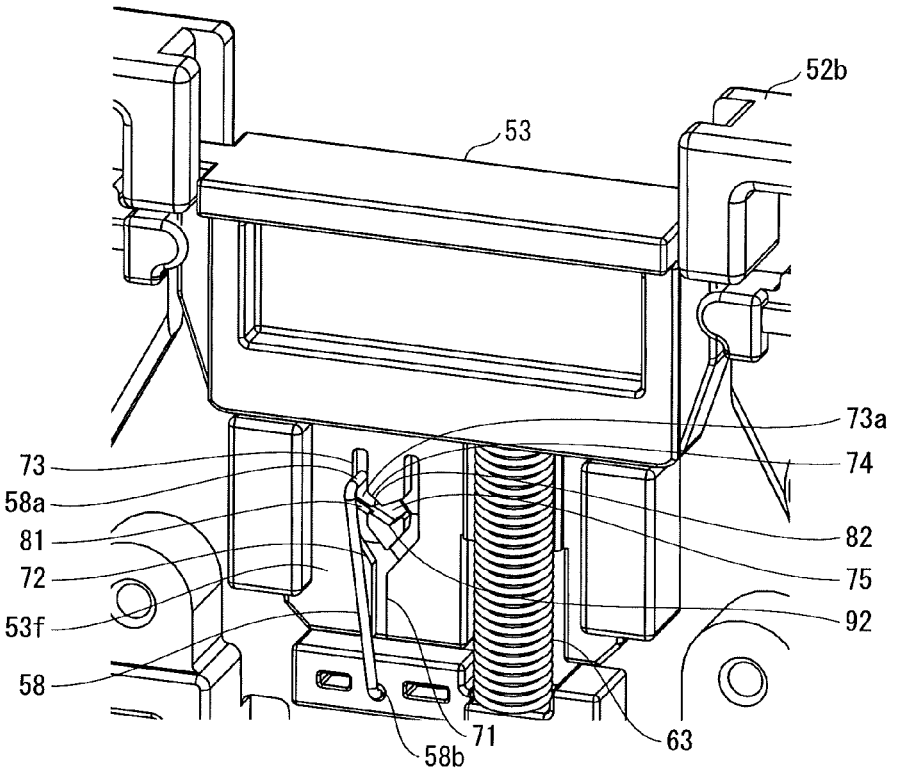
FIG. 13 is another view illustrating the relative movement of the bent portion of the guiding rod relative to the guiding groove in accordance with the push-down operation of the operation member.

When a user pushes down the operation member 53 at the initial position, the guiding groove arrangement portion 53*f*, at which the guiding groove 53*h* is arranged, descends in accordance with descending of the operation member 53 as illustrated in FIG. 13. Because the lower end 58*b* of the guiding rod 58 is fixed to the upper body portion 52*b*, the guiding rod 58 does not move in the Z-axis direction even when the guiding groove arrangement portion 53*f* descends.

Because the guiding groove 53*h* moves downward relative to the guiding rod 58, the bent portion 58*a* moves relative to the guiding groove arrangement portion 53*f* in accordance with descending of the guiding groove arrangement portion 53*f*, so that the bent portion 58*a* is guided along the guiding groove 53*h*.

FIG. 13 illustrates the bent portion 58*a* which, due to descending of the operation member 53, has moved from the groove 71 and the groove 72, through the level difference 81, to the groove 73. As the operation member 53 descends, the levers 54 and 55 swing in the directions indicated by arrows D illustrated in FIG. 8A. Consequently, the protrusions 54*c* and the protrusions 55*c* disengage from the recesses 16*c* of the bottom surface 10 and the unlocked state is achieved. In this sense, the operation member 53 functions as an unlocking portion (releaser) that, upon receiving a user operation, releases locking of the rear end regulation plate 15 locked by the levers 54 and 55.

In the present embodiment, the levers 54 and 55 are not engaged with the recesses 16*c* of the bottom surface 10 (i.e. the unlocked state) when the bent portion 58*a*, which is guided along the guiding groove 53*h*, is at any position above a boundary position 101 (broken line) illustrated in FIG. 10A. When the bent portion 58*a* arrives at a home position 100 (broken line), returning to the locked state is achieved.

As illustrated in FIG. 12, the position of the angular portion 93 of the central region 90 at the guiding groove arrangement portion 53*f* is removed to the right from the groove 71. Consequently, when the guiding groove arrangement portion 53*f* descends in the Z-axis direction, the bent portion 58*a* is guided from the groove 71 to the groove 72, which is removed to the left from the angular portion 93. In other words, a distance in the Y-axis direction of the angular portion 93 of the central region 90 relative to the groove 71 is predetermined so that the bent portion 58*a* is always guided from the groove 71 to the groove 72.

Further, the bent portion 58*a* is biased by the biasing force from the leaf spring 59 described above so that the bent portion 58*a* is always in contact with the bottom surface 79 of the guiding groove 53*h*. Due to this, the bent portion 58*a* is prevented from moving over the level difference 84, and cannot move from the groove 71 to the groove 77 before reaching the angular portion 93. The bent portion 58*a* thus is guided along the level difference 84 inclining obliquely left and upward, and to the groove 72.

When the user removes her or his hand from the operation member 53 in the unlocked state illustrated in FIG. 13, the push-down force by the user is no longer applied to the operation member 53. Consequently, the operation member 53 starts to move upward (in a direction returning to the initial position) because of the biasing forces from the compression springs 61 through 63.

Figure 14:
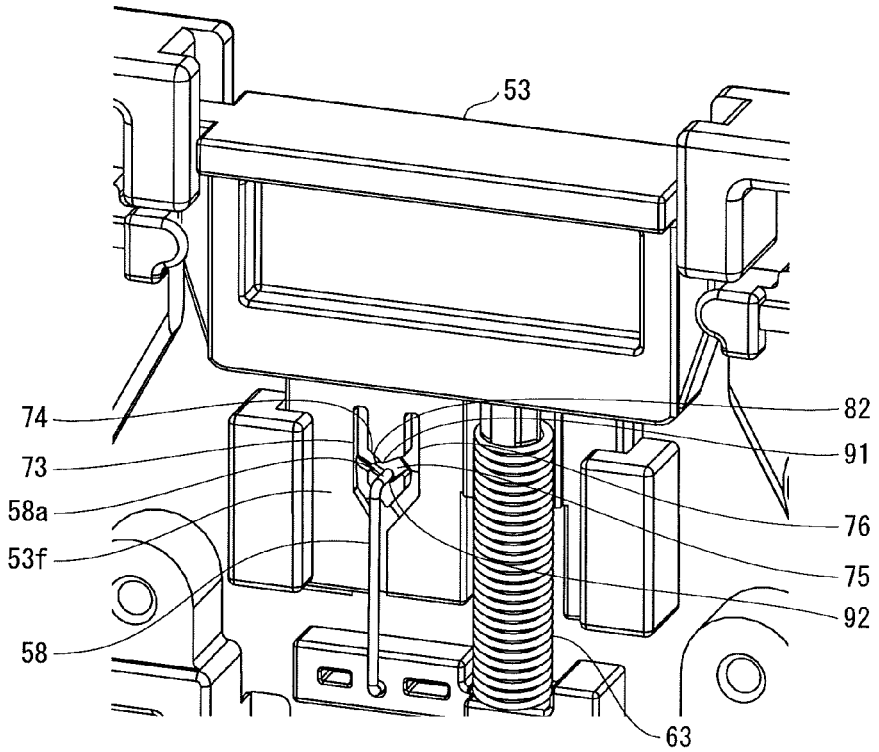
FIG. 14 is another view illustrating the relative movement of the bent portion of the guiding rod relative to the guiding groove in accordance with the push-down operation of the operation member.

When the operation member 53 moves upward, the bent portion 58*a* moves from the groove 73, through the branching position 73*a*, to the groove 74, then through the level difference 82 to the V-shaped groove 75, and is hooked to the angular portion 92 (bending portion) of the lower side wall 75*b* of the groove 75 as illustrated in FIG. 14.

The biasing force from the compression spring 63 in the upward direction is continuously applied to the operation member 53. However, an upward movement of the operation member 53 is prevented when the bent portion 58*a* is hooked to the angular portion 92 of the groove 75. This causes the operation member 53 to stop. In this sense, the guiding rod 58 functions as a stopper that prevents the operation member 53, when no operation (operation force) is applied by a user, from moving to its original initial position due to the biasing forces from the compression springs 61 through 63.

Because a position at which the operation member 53 stops illustrated in FIG. 14 is above the boundary position 101 illustrated in FIG. 10A, the levers 54 and 55 are not yet engaged with the recesses 16*c* of the bottom surface 10; that is, the rear end regulation plate 15 remains unlocked.

The position at which the operation member 53 stops when the bent portion 58*a* is at the angular portion 92 (bending portion) of the groove 75 as illustrated in FIG. 14 is hereinafter referred to as an unlocking holding position. Further, the positions of the levers 54 and 55 (the positions illustrated by broken line 54*f* in FIG. 11B; that is, positions at which the levers 54 and 55 are disengaged from the recesses 16*c*) when the operation member 53 is at the unlocking holding position are hereinafter referred to as disengagement positions. In this sense, the guiding groove arrangement portion 53*f*, at which the guiding groove 53*h* is arranged, and the guiding rod 58 function as unlocking holding portions that hold the locking member after unlocking at the disengagement positions.

When the operation member 53 is at the unlocking holding position, no push-down force from a user is applied to the operation member 53 because the user has removed her or his hand from the operation member 53. That is, the unlocking is maintained without relying upon a user operation (in other words, a force applied by a user).

The user can move the rear end regulation plate 15 along the groove portion 16*b* of the guiding region 16 to a desired regulation position by applying only a small amount of force while the unlocking is maintained.

When the user removes her or his hand from the operation member 53 in FIG. 13 and the operation member 53 starts to be moved upward by the biasing forces from the compression springs 61 through 63, a downward movement of the bent portion 58*a* along the groove 73 is prevented by the level difference 81 and the bent portion 58*a* does not return to the groove 72. The bent portion 58*a* thus is guided along the level difference 81, which inclines obliquely right and downward, through the branching position 73*a*, and to the groove 74 and the groove 75 in this order.

In this sense, the level difference 81 functions as a switching portion having the following functions. Firstly, the switching portion guides the bent portion 58*a* (engagement protrusion) of the guiding rod 58, which has been guided along the grooves 71 and 72 (first groove portion), so that the bent portion 58*a* enters the groove 73 (second groove portion) from the branching position 73*a*. Due to no operation by the user being applied to the operation member 53, the operation member 53 moves in the direction returning to the initial position. Then, the switching portion guides the bent portion 58*a*, which moves along the groove 73 in a direction returning to the branching position 73*a*, so that the bent portion 58*a* enters the grooves 74 and 75 (second groove) from the branching position 73*a*, in accordance with the movement of the operation member 53 returning to the initial position.

The switching portion is not limited to the example of the level difference 81; it suffices that the switching portion has the function of switching the destination of the bent portion 58*a*. One example of a mechanism that may be used as the switching portion is a branching mechanism that allows the bent portion 58*a* to proceed from the groove 72 to the groove 73 and from the groove 73 to the groove 74 while preventing the bent portion 58*a* from returning from the groove 73 to the groove 72.

Figure 15:
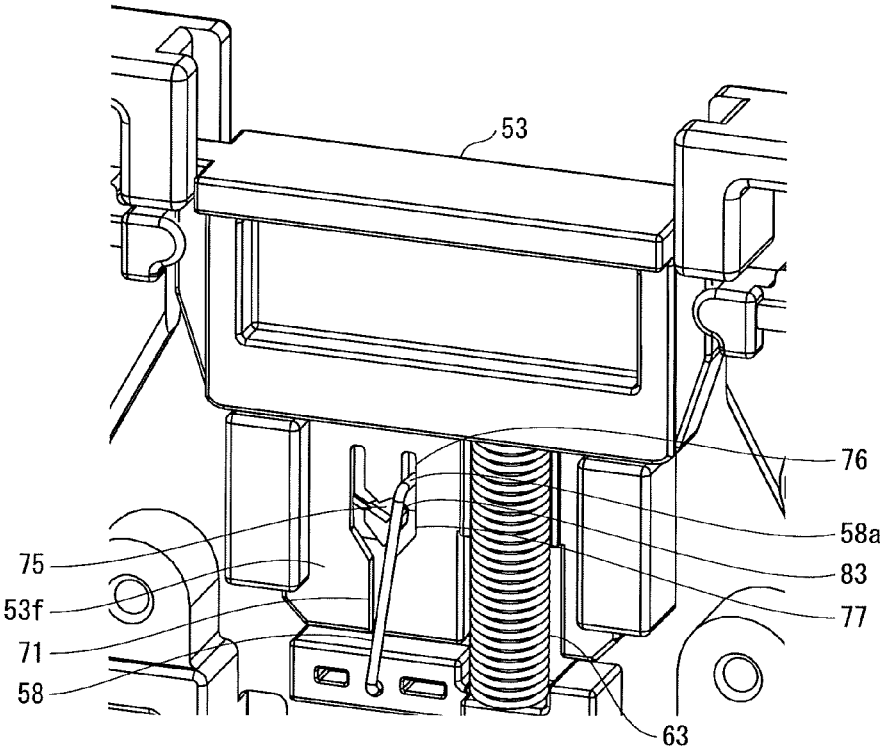
FIG. 15 is another view illustrating the relative movement of the bent portion of the guiding rod relative to the guiding groove in accordance with the push-down operation of the operation member.

When the user has moved the rear end regulation plate 15 to a desired regulation position and pushes down the operation member 53 illustrated in FIG. 14, a downward movement of the operation member 53 due to the user's push-down operation as illustrated in FIG. 15 causes the bent portion 58*a* to move from groove 75, through the level difference 83, to the groove 76.

When the operation member 53 descends due to the push-down operation in FIG. 14, the level difference 82 prevents the bent portion 58*a* from moving back from the groove 75 to the groove 74. Further, the position of the angular portion 92 of the lower side wall 75*b* forming the V-shaped groove 75 is removed to the right from the position of the angular portion 91 of the upper side wall 75*a*. Consequently, when the guiding groove arrangement portion 53*f* descends in the Z-axis direction, the bent portion 58*a*, which is hooked to the angular portion 92, is guided to the right along a portion of the V-shaped groove 75 relative to the angular portion 91 and arrives at the groove 76. Positions of the angular portions 91 and 92 relative to each other are predetermined so that the bent portion 58*a* is guided from the groove 75 to the groove 76 smoothly as described above.

Figure 16:
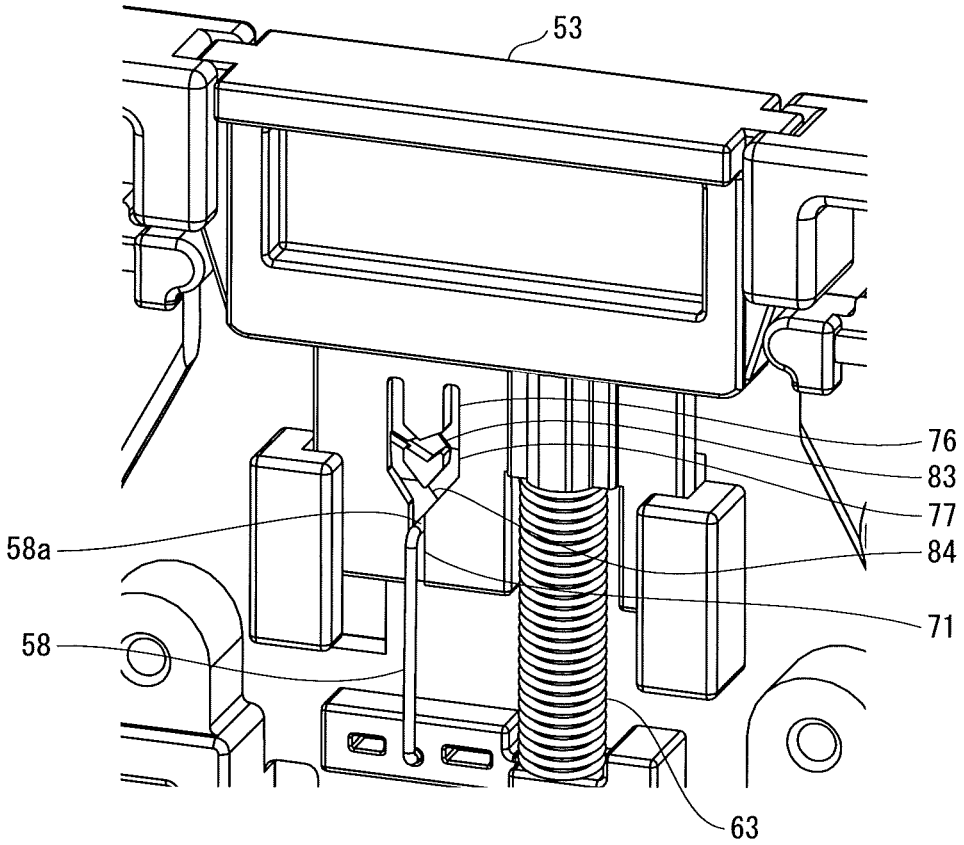
FIG. 16 is another view illustrating the relative movement of the bent portion of the guiding rod relative to the guiding groove in accordance with the push-down operation of the operation member.

When the user removes her or his hand from the operation member 53 in a state in which the operation member 53 has been pushed down as illustrated in FIG. 15, the operation member 53 moves upward due to the biasing forces from the compression springs 61 through 63. This causes the bent portion 58*a* to move from the groove 76, through the groove 77 and the level difference 84, to the home position at the groove 71, and the operation member 53 eventually returns to the initial position as illustrated in FIG. 16. Consequently, the rear end regulation plate 15, which has been moved to the desired regulation position, transits to the locked state at the desired regulation position.

When the user pushes down the operation member 53 (FIG. 14) resting at the unlocking holding position, the bent portion 58*a* and the angular portion 92 (bending portion) of the groove 75 disengage from each other, and the unlocking holding that has been maintained by the engagement of the bent portion 58*a* and the angular portion 92 is terminated (FIG. 15). In this sense, the grooves 76 and 77 of the operation member 53 function as a holding terminating portion that terminates holding of the unlocking when the operation member 53, which rests at the unlocking holding position, receives a force in the same direction (direction from upward to downward) as the force that has been applied when unlocking the operation member 53.

Further, the grooves 76 and 77 function as third grooves for guiding the bent portion 58*a* (engagement protrusion) of the guiding rod 58 back from the angular portion 92 of the groove 75 to the home position at the groove 71.

When the operation member 53 ascends due to the biasing forces from the compression springs 61 through 63 because the user has removed her or his hand from the operation member 53 in FIG. 15, the level difference 83 prevents the bent portion 58*a* from moving back from the groove 76 to the groove 75. The bent portion 58*a* thus is guided along the level difference 83, which inclines obliquely right and downward, to the groove 77.

As described above, in the present embodiment, a user can establish unlocking of the rear end regulation plate 15 and maintain the unlocking of the rear end regulation plate 15 by pushing down the operation member 53 one time when in the locked state. By pushing down the operation member 53 one time when in the holding unlocking state, the user can terminate holding of the unlocking, and returning to the locked state is achieved.

Consequently, the user does not have to apply a force for maintaining the unlocking to the rear end regulation plate 15 in the unlocking holding state while the user moves the rear end regulation plate 15. The user can move the rear end regulation plate 15 in the sheet feed direction by applying a small amount of force with her or his finger to the rear end regulation plate 15. This accordingly reduces the user's burden and facilitates moving of the rear end regulation plate 15.

Further, in the present embodiment, the shapes of the recesses 16*c* at the guiding region 16 of the bottom surface 10, the protrusions 54*c*, and the protrusions 55*c* are devised so that the rear end regulation plate 15 can be unlocked even when in the locked state, upon receiving a force greater than a certain amount.

Specifically, as illustrated in FIG. 11A, for each of the recesses 16*c*, a side wall 16*d* at a front in the sheet feed direction (direction indicated by arrow A) is parallel to a direction (Y-axis direction) orthogonal to the sheet feed direction. The protrusions 54*c* have a triangular shape, and an edge 54*d* at a front of the protrusions 54*c* in the sheet feed direction inclines in a direction (direction opposite the sheet feed direction) away from the side wall 16*d* toward a tip of an edge 54*d* relative to the direction (Y-axis direction) of the side wall 16*d* of the recess 16*c*. When a force in the sheet feed direction is applied to the rear end regulation plate 15 in the locked state, the edge 54*d* of the protrusions 54*c* contacts the side wall 16*d* of the recess 16*c*.

The edge 54*d* of the protrusions 54*c*, which inclines relative to the Y-axis direction, receives a force (reaction) from the side wall 16*d*. Here, a component of the force (reaction) in a direction indicated by arrow Y functions as a force moving the lever 54 in the direction indicated by arrow Y. A biasing force in a direction opposite the direction indicated by arrow Y is applied to the lever 54 by the compression spring 61. When the force in the direction indicated by arrow Y applied to the protrusions 54*c* becomes greater than the force applied by the compression spring 61, the lever 54 moves in the direction indicated by arrow Y and the rear end regulation plate 15 is unlocked.

Accordingly, even when a user forgets to push down the operation member 53 of the rear end regulation plate 15 and applies a force greater than necessary to the rear end regulation plate 15 in the locked state in order to forcibly move the rear end regulation plate 15 in the sheet feed direction, the protrusions 54*c* move so as to escape from the recess 16*c*, leading to the rear end regulation plate 15 unlocking. This structure prevents problems such as breakage of the protrusions 54*c*. The protrusions 55*c* have a similar structure.

Meanwhile, an edge 54*e* of the protrusions 54*c* at a back in the sheet feed direction is parallel to the Y-axis direction. Accordingly, even when a force in a direction opposite the sheet feed direction is applied, the locked state is maintained. For example, the edge 54*e* of the protrusions 54*c* may also incline in a direction (sheet feed direction) away from the side wall 16*e* of the recess 16*c* toward the tip of the edge 54*e*. Alternatively, the edges 54*d* and 54*e* of the protrusions 54*c* may both be parallel to the Y-axis direction.

Modifications

Although description of the present invention has been provided with reference to an embodiment thereof, the present invention should not be construed as being limited to the above embodiment, and the following modifications are possible.

(1) In the above embodiment, the guiding groove arrangement portion 53*f* of the operation member 53 has the Y-shaped guiding groove 53*h*, and the bent portion 58*a* is guided along the guiding groove 53*h* in accordance with ascending and descending of the operation member 53. However, the present invention should not be construed as being limited to this. The present invention may also include structures that achieve, after transition from the locked state to the unlocked state, switching into the unlocking holding state that maintains the unlocking and switching from the unlocking holding state into the locked state.

For example, as an example of alternating actions, a ratchet cam system may be adopted to achieve a structure in which a cam rotates at a predetermined angle and stops each time the operation member 53 is pushed down. In this structure, upon each rotation of the cam at the predetermined angle, one of the following is alternately performed due to swinging of the levers 54 and 55: (i) the levers 54 and 55 moving from the engagement positions illustrated in FIG. 11A to the disengagement positions (broken line) illustrated in FIG. 11B and resting at the disengagement positions; and (ii) the levers 54 and 55 moving from the disengagement positions to the engagement positions and resting at the engagement positions. Alternatively, a so-called rotary cam system may be used.

(2) The above embodiment describes a structure in which the operation member 53 has the guiding groove 53*h* and the guiding rod 58 (engagement protrusion) is fixed to the body 52, but the present invention should not be construed as being limited to this. For example, the present invention may also include a structure in which the body 52 has a guiding groove and the operation member 53 has an engagement protrusion. In such a structure, the guiding groove at the body 52 may be a vertical inversion of the guiding groove

53*h* illustrated in FIG. 10A. In this structure, the engagement protrusion fixed to the operation member 53 is guided along the guiding groove at the body 52, in a manner similar to the present embodiment. Consequently, after transition from the locked state to the unlocked state, switching into the unlocking holding state and switching from the unlocking holding state into the locked state are alternately performed each time a user pushes down the operation member 53.

That is, when a user pushes down the operation member 53 at the initial position (locked state), the engagement protrusion fixed to the operation member 53 is guided along the grooves 71 through 73 (first groove) of the guiding groove at the body 52 in accordance with descending of the operation member 53. When the operation member 53 starts to ascend due to the user removing her or his hand from the operation member 53, the engagement protrusion of the operation member 53 is guided along the groove 73, through the branching position 73*a*, and to the groove 74 and the groove 75, and the operation member 53 stops at the unlocking holding position (unlocking holding state).

When the user pushes down the operation member 53 resting at the unlocking holding position, the engagement protrusion fixed to the operation member 53 is guided from the groove 75 along the groove 76. When the operation member 53 starts to ascend due to the user removing her or his hands from the operation member 53, the engagement protrusion of the operation member 53 is guided from the groove 76, through the groove 77, to the groove 71, and the operation member 53 stops at the initial position (locked state).

(3) In the above embodiment, the user performs an operation of pushing down the operation member 53, but the present invention should not be construed as being limited to this. For example, the present invention may also include a structure in which the operation member 53 is pulled up. Specifically, the tapered portion 53*d* of the operation member 53 illustrated in FIG. 9 is wider toward its lower end. When the operation member 53 is at the initial position, the upper end 54*a* of the lever 54 is in contact with a corresponding vertical surface 53*n* of the ridge portion 53*c*. The lever 55 has a similar structure. Further, the guiding groove 53*h* of the operation member 53 has an inverse Y-shape, and a tension spring is used instead of the compression spring 63.

In such a structure, the operation member 53 always receives a biasing force in the downward direction from the tension spring. When the user pulls up the operation member 53 from the initial position, the bent portion 58*a* is guided along the guiding groove 53*h* in the order of the groove 71, the groove 72, and the groove 73, and the unlocked state is achieved. When the user removes her or his hand from the operation member 53 after unlocking, the operation member 53 starts to descend. In accordance with the start of descending of the operation member 53, the bent portion 58*a* is guided in the order or the groove 73, the groove 74, and the groove 75, and the bent portion 58*a* is hooked to the angular portion 92 of the groove 75. This causes the operation member 53 to stop in the middle of descending (unlocking holding).

When the user pulls up the operation member 53 and then removes her or his hand from the operation member 53, the bent portion 58*a* is guided to the groove 75, the groove 76, and the groove 77 in this order, and returns to the groove 71, and the operation member 53 stops at the initial position (locked state).

(4) In the above embodiment, the operation member 53 functions both as the disengaging portion establishing the unlocking of the levers 54 and 55 and the unlocking holding portion maintaining the unlocking, but the present invention should not be construed as being limited to this.

For example, the present invention may also include a structure in which unlocking is performed by the operation member 53 and holding of the unlocking is performed by a hook-shaped member other than the operation member 53. Specifically, such a hook-shaped member may be a stopper that is directly hooked to (engaged with) the levers 54 and 55 when the levers 54 and 55 move to the disengagement positions and holds the levers 54 and 55 at the disengagement positions against the biasing forces from the compression springs. The present invention may further include, for example, another holding terminating member that terminates holding of unlocking by engaging with the stopper upon receiving an operation force by a user and consequently disengaging the stopper from the levers 54 and 55.

(5) The above embodiment describes a structure in which compression springs are used as members biasing the levers 54 and 55 to the engagement positions, at which the levers 54 and 55 engage with the recesses 16*c*. However, the present invention should not be construed as being limited to this, and another elastic member or the like may be used as a biasing member.

(6) The above embodiment describes an example of a structure in which the sheet stacking device is applied to a tandem-type printer as an example of an image forming device, but the present invention should not be construed as being limited to this. The present invention is applicable to sheet stacking devices in image forming devices such as copiers, facsimile devices, and multi-function peripherals (MFPs).

Further, description is given of an example of a structure of the rear end regulation plate 15 as a regulation member regulating sheets housed in the sheet feed cassette 31, but the present invention should not be construed as being limited to this. For example, the present invention is applicable to the side regulation plates 13 and 14. Further, the present invention should not be construed as being applicable only to the sheet feed cassette 31. For example, the present invention is applicable to a structure in which the storage tray 36, in which a sheet after image forming is stacked and housed, has a regulation member.

Further, in the above embodiment, the locking of the rear end regulation plate 15 is achieved by the protrusions 54*c* (engaged portion) of the lever 54 engaging with a recess (engaging portion) 16*c* of the bottom surface 10. However, the present invention should not be construed as being limited to engagement between a protrusion and a recess. For example, the present invention may also include a structure in which the rear end regulation plate 15 has a protruding portion and the bottom surface 10 has a rack with which the protruding portion engages.

Further, in the above embodiment, the rear end regulation plate 15 is supported so that the rear end regulation plate 15 is movable along the guiding region 16 of the bottom surface 10. However, the present invention should not be construed as being limited to this; any structure is possible as long as the rear end regulation plate 15 is supported by the sheet stack unit 10*a*, so that the rear end regulation plate 15 is movable in a direction toward sheets S stacked and housed on the bottom surface 10 and in a direction away from the sheets S.

Further, any possible combinations of the above-described embodiment and the modifications are construed as being included in the scope of the present invention.

SUMMARY

The above embodiment and modifications represent one aspect for solving the problem described in "Problems to be Solved by the Invention", and is summarized as in the following.

That is, a sheet stacking device reflecting one aspect of the present invention includes: a stacking unit in which a sheet is stacked; and a regulation member that is movably supported by the stacking unit and is brought into contact with an edge of the sheet to regulate a position of the sheet. In the sheet stacking device, the regulation member includes: a locking member that is movable between an engagement position and a disengagement position, the engagement position being a position at which the locking member is engaged with an engaging portion of the stacking unit, and the disengagement position being a position at which the locking member is disengaged from the engaging portion; a biasing member that biases the locking member toward the engagement position; a force receiver that receives a user operation; a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

In the sheet stacking device, the regulation member may further include a body, the force receiver and the releaser forming an operation member that is supported by the body and movable in the first direction, the releaser may apply the second force to the locking member when the operation member moves in the first direction from an initial position due to a user operation, the initial position being a position of the operation member when the locking member is at the engagement position, the operation member may be biased toward the initial position by the biasing member after the locking member disengages from the engaging position and a user operation is not applied to the operation member, and the stopper may engage with the operation member and act against the biasing force from the biasing member to stop the operation member at an unlocking holding position, thereby holding the locking member at the disengagement position.

In the sheet stacking device, the releaser may have a tapered surface that is a surface of a tapered portion of the releaser, the tapered portion tapering relative to the first direction, and converting the first force into the second force in accordance with an angle at which the tapered portion tapers and applies the second force to the locking member.

The sheet stacking device may further include a holding terminating portion that disengages the operation member resting at the unlocking holding position and the stopper, thereby terminating holding of the locking member at the disengagement position by the stopper.

In the sheet stacking device, when a force in the first direction is applied to the operation member resting at the unlocking holding position, the holding terminating portion may release the engagement between the operation member and the stopper with use of the force in the first direction.

In the sheet stacking device, the operation member may have a guiding groove defined by guiding groove walls, the stopper may be an engagement protrusion that is fixed to the body and engages with a surface of the guiding groove walls, the guiding groove may include: a first groove elongated in the first direction; a second groove branching from a branching position of the first groove; and a switching portion at the branching position, the first groove may be divided, at the branching position, into a first groove portion and a second groove portion, the second groove may include an inclining groove portion and a bending groove portion, the bending groove portion having a bending portion, when denoting a direction that is along the first groove portion and away from the branching position as a third direction, the inclining groove portion may extend from the branching position at an acute angle from the third direction and connect to the bending groove portion, the bending groove portion may bend at the bending portion in a direction away from the third direction, when denoting a position of the engagement protrusion when the operation member is at the initial position as a home position, as the operation member moves in the first direction from the initial position and the engagement protrusion moves from the home position along the first groove portion toward the branching position, the switching portion may guide the engagement protrusion so that the engagement protrusion passes the branching position and enters the second groove portion, and when the engagement protrusion is at the second groove portion and the user operation is not applied, the switching portion, as the operation member moves toward the initial position and the engagement protrusion moves in a direction returning to the branching position along the second groove portion, may guide the engagement protrusion so that the engagement protrusion moves from the branching position, through the inclining groove portion, to the bending portion of the bending groove portion.

In the sheet stacking device, when a force in the first direction is applied by a user to the operation member resting at the unlocking holding position, the operation member may move from the unlocking holding position, subsequently, when a user operation is not applied to the operation member, the operation member may return to the initial position due to the biasing force from the biasing member, the guiding groove may include a third groove, and when the engagement protrusion moves from the bending portion in accordance with a movement of the operation member from the unlocking holding position to the initial position, the engagement protrusion may be guided by the third groove to the home position at the first groove portion.

In the sheet stacking device, the operation member may further include an engagement protrusion, the body may have a guiding groove defined by guiding groove walls, the stopper may be a surface of the guiding groove walls that engages with the engagement protrusion, the guiding groove may include: a first groove elongated in the first direction; a second groove branching from a branching position of the first groove; and a switching portion at the branching position, the first groove may be divided, at the branching position, into a first groove portion and a second groove portion, the second groove may include an inclining groove portion and a bending groove portion, the bending groove portion having a bending portion, when denoting a direction that is along the first groove portion and away from the branching position as a third direction, the inclining groove portion may extend from the branching position at an acute angle from the third direction and connect to the bending groove portion, the bending groove portion may bend at the bending portion in a direction away from the third direction, when denoting a position of the engagement protrusion when the operation member is at the initial position as a home position, as the operation member moves in the first direction from the initial position and the engagement protrusion moves from the home position along the first groove portion toward the branching position, the switching portion may guide the engagement protrusion so that the engagement protrusion passes the branching position and enters the second groove portion, and when the engagement protrusion is at the second groove portion and the user operation is not applied, the switching portion, as the operation member moves toward the initial position and the engagement protrusion moves in a direction returning to the branching position along the second groove portion, may guide the engagement protrusion so that the engagement protrusion moves from the branching position, through the inclining groove portion, to the bending portion of the bending groove portion.

In the sheet stacking device, when a force in the first direction is applied by a user to the operation member resting at the unlocking holding position, the operation member may move from the unlocking holding position, subsequently, when a user operation is not applied to the operation member, the operation member may return to the initial position due to the biasing force from the biasing member, the guiding groove may include a third groove, and when the engagement protrusion moves from the bending portion in accordance with a movement of the operation member from the unlocking holding position to the initial position, the engagement protrusion may be guided by the third groove to the home position at the first groove portion.

In the sheet stacking device, the first direction may be a direction in which the operation member is pushed down.

The sheet stacking device may further include a holding terminating portion terminating holding of the locking member at the disengagement position by the stopper.

An image forming device reflecting another aspect of the present invention conveys a sheet from a sheet stacking unit to a conveyance path and forms an image on the sheet, the image forming device including: a regulation member that is movably supported by the sheet stacking unit and is brought into contact with an edge of the sheet to regulate a position of the sheet. In the image forming device, the regulation member includes: a locking member that is movable between an engagement position and a disengagement position, the engagement position being a position at which the locking member is engaged with an engaging portion of the sheet stacking unit, and the disengagement position being a position at which the locking member is disengaged from the engaging portion; a biasing member that biases the locking member toward the engagement position; a force receiver that receives a user operation; a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

A regulation member reflecting yet another aspect of the present invention is movably supported by a stacking unit in which a sheet is stacked and is brought into contact with an edge of the sheet to regulate a position of the sheet, the regulation member including: a locking member that is movable between an engagement position and a disengagement position, the engagement position being a position at which the locking member is engaged with an engaging portion of the stacking unit, and the disengagement position being a position at which the locking member is disengaged from the engaging portion; a biasing member that biases the locking member toward the engagement position; a force receiver that receives a user operation; a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

The above-described structure maintains the unlocked state with use of the stopper, without relying upon a user operation. Because of this, a user does not have to apply to the regulation member a force greater than, for example, a restoring force of a spring for performing unlocking. The user can move the regulation member to a regulation position by applying a small amount of force with his/her finger to the regulation member. This makes it easy for the user to move the regulation member.

Although one or more embodiments of the present invention have been described and illustrated in detail, it is clearly understood that the same is by way of illustration and example only and not limitation; the scope of the present invention should be interpreted by terms of the appended claims.

What is claimed is:

1. A sheet stacking device, comprising:

a stacking unit in which a sheet is stacked; and a regulation member that is movably supported by the stacking unit and is brought into contact with an edge of the sheet to regulate a position of the sheet, wherein the regulation member includes:

a locking member that is movable between an engagement position and a disengagement position, the engagement position being a position at which the locking member is engaged with an engaging portion of the stacking unit, and the disengagement position being a position at which the locking member is disengaged from the engaging portion;

a biasing member that biases the locking member toward the engagement position;

a force receiver that receives a user operation;

a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

2. The sheet stacking device of claim 1, wherein the regulation member further includes a body, the force receiver and the releaser form an operation member that is supported by the body and movable in the first direction, the releaser applies the second force to the locking member when the operation member moves in the first direction from an initial position due to a user operation, the initial position being a position of the operation member when the locking member is at the engagement position, the operation member is biased toward the initial position by the biasing member after the locking member disengages from the engaging position and a user operation is not applied to the operation member, and the stopper engages with the operation member and acts against the biasing force from the biasing member to stop the operation member at an unlocking holding position, thereby holding the locking member at the disengagement position.

3. The sheet stacking device of claim 2, wherein the releaser:

has a tapered surface that is a surface of a tapered portion of the releaser, the tapered portion tapering relative to the first direction, and converts the first force into the second force in accordance with an angle at which the tapered portion tapers and applies the second force to the locking member.

4. The sheet stacking device of claim 2 further comprising a holding terminating portion that disengages the operation member resting at the unlocking holding position and the stopper, thereby terminating holding of the locking member at the disengagement position by the stopper.

5. The sheet stacking device of claim 4, wherein when a force in the first direction is applied to the operation member resting at the unlocking holding position, the holding terminating portion releases the engagement between the operation member and the stopper with use of the force in the first direction.

6. The sheet stacking device of claim 2, wherein the operation member has a guiding groove defined by guiding groove walls, the stopper is an engagement protrusion that is fixed to the body and engages with a surface of the guiding groove walls, the guiding groove includes:

a first groove elongated in the first direction;

a second groove branching from a branching position of the first groove; and a switching portion at the branching position, the first groove is divided, at the branching position, into a first groove portion and a second groove portion, the second groove includes an inclining groove portion and a bending groove portion, the bending groove portion having a bending portion, when denoting a direction that is along the first groove portion and away from the branching position as a third direction, the inclining groove portion extends from the branching position at an acute angle from the third direction and connects to the bending groove portion, the bending groove portion bends at the bending portion in a direction away from the third direction, when denoting a position of the engagement protrusion when the operation member is at the initial position as a home position, as the operation member moves in the first direction from the initial position and the engagement protrusion moves from the home position along the first groove portion toward the branching position, the switching portion guides the engagement protrusion so that the engagement protrusion passes the branching position and enters the second groove portion, and when the engagement protrusion is at the second groove portion and the user operation is not applied, the switching portion, as the operation member moves toward the initial position and the engagement protrusion moves in a direction returning to the branching position along the second groove portion, guides the engagement protrusion so that the engagement protrusion moves from the branching position, through the inclining groove portion, to the bending portion of the bending groove portion.

7. The sheet stacking device of claim 6, wherein when a force in the first direction is applied by a user to the operation member resting at the unlocking holding position, the operation member moves from the unlocking holding position, subsequently, when a user operation is not applied to the operation member, the operation member returns to the initial position due to the biasing force from the biasing member, the guiding groove includes a third groove, and when the engagement protrusion moves from the bending portion in accordance with a movement of the operation member from the unlocking holding position to the initial position, the engagement protrusion is guided by the third groove to the home position at the first groove portion.

8. The sheet stacking device of claim 2, wherein the operation member further includes an engagement protrusion, the body has a guiding groove defined by guiding groove walls, the stopper is a surface of the guiding groove walls that engages with the engagement protrusion, the guiding groove includes:

a first groove elongated in the first direction;

a second groove branching from a branching position of the first groove; and a switching portion at the branching position, the first groove is divided, at the branching position, into a first groove portion and a second groove portion, the second groove includes an inclining groove portion and a bending groove portion, the bending groove portion having a bending portion, when denoting a direction that is along the first groove portion and away from the branching position as a third direction, the inclining groove portion extends from the branching position at an acute angle from the third direction and connects to the bending groove portion, the bending groove portion bends at the bending portion in a direction away from the third direction, when denoting a position of the engagement protrusion when the operation member is at the initial position as a home position, as the operation member moves in the first direction from the initial position and the engagement protrusion moves from the home position along the first groove portion toward the branching position, the switching portion guides the engagement protrusion so that the engagement protrusion passes the branching position and enters the second groove portion, and when the engagement protrusion is at the second groove portion and the user operation is not applied, the switching portion, as the operation member moves toward the initial position and the engagement protrusion moves in a direction returning to the branching position along the second groove portion, guides the engagement protrusion so that the engagement protrusion moves from the branching position, through the inclining groove portion, to the bending portion of the bending groove portion.

9. The sheet stacking device of claim 8, wherein when a force in the first direction is applied by a user to the operation member resting at the unlocking holding position, the operation member moves from the unlocking holding position, subsequently, when a user operation is not applied to the operation member, the operation member returns to the initial position due to the biasing force from the biasing member, the guiding groove includes a third groove, and when the engagement protrusion moves from the bending portion in accordance with a movement of the operation member from the unlocking holding position to the initial position, the engagement protrusion is guided by the third groove to the home position at the first groove portion.

10. The sheet stacking device of claim 1, wherein the first direction is a direction in which the force receiver is pushed down.

11. The sheet stacking device of claim 1 further comprising a holding terminating portion terminating holding of the locking member at the disengagement position by the stopper.

12. An image forming device that conveys a sheet from a sheet stacking unit to a conveyance path and that forms an image on the sheet, the image forming device comprising:

a regulation member that is movably supported by the sheet stacking unit and is brought into contact with an edge of the sheet to regulate a position of the sheet, wherein the regulation member includes:

a locking member that is movable between an engagement position and a disengagement position, the engagement position being a position at which the locking member is engaged with an engaging portion of the sheet stacking unit, and the disengagement position being a position at which the locking member is disengaged from the engaging portion;

a biasing member that biases the locking member toward the engagement position;

a force receiver that receives a user operation;

a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

13. A regulation member that is movably supported by a stacking unit in which a sheet is stacked and that is brought into contact with an edge of the sheet to regulate a position of the sheet, the regulation member comprising:

a locking member that is movable between an engagement position and a disengagement position, the engagement position being a position at which the locking member is engaged with an engaging portion of the stacking unit, and the disengagement position being a position at which the locking member is disengaged from the engaging portion;

a biasing member that biases the locking member toward the engagement position;

a force receiver that receives a user operation;

a releaser that converts a first force in a first direction applied to the force receiver by a user operation into a second force in a second direction opposing a biasing force from the biasing member and being applied to the locking member, moving the locking member from the engagement position to the disengagement position; and a stopper that, after the locking member disengages from the engaging portion and a user operation is not applied to the force receiver, prevents a movement of the locking member back to the engagement position due to the biasing force from the biasing member.

* * * * *